US007222676B2

(12) United States Patent
Patel et al.

(10) Patent No.: US 7,222,676 B2
(45) Date of Patent: May 29, 2007

(54) WELL COMMUNICATION SYSTEM

(75) Inventors: Dinesh R. Patel, Sugar Land, TX (US); Rodney J. Wetzel, Katy, TX (US); Peter V. Howard, Bellville, TX (US); Patrick W. Bixenman, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/431,284

(22) Filed: May 7, 2003

(65) Prior Publication Data

US 2003/0221829 A1 Dec. 4, 2003

Related U.S. Application Data

(63) Continuation-in-part of application No. 10/125,447, filed on Apr. 18, 2002, now Pat. No. 6,789,621, which is a continuation-in-part of application No. 10/021,724, filed on Dec. 12, 2001, now Pat. No. 6,695,054, and a continuation-in-part of application No. 10/079,670, filed on Feb. 20, 2002, now Pat. No. 6,848,510, and a continuation-in-part of application No. 09/981,072, filed on Oct. 16, 2001, now Pat. No. 6,681,854, and a continuation-in-part of application No. 09/973,442, filed on Oct. 9, 2001, now Pat. No. 6,799,637, and a continuation-in-part of application No. 09/732,134, filed on Dec. 7, 2000, now Pat. No. 6,446,729.

(60) Provisional application No. 60/407,078, filed on Aug. 30, 2002, provisional application No. 60/418,487, filed on Oct. 15, 2002, provisional application No. 60/432,343, filed on Dec. 10, 2002.

(51) Int. Cl.
*E21B 19/00* (2006.01)

(52) U.S. Cl. ..... 166/378; 166/278; 166/51

(58) Field of Classification Search ..... 166/378, 166/387, 278, 51, 276, 66, 227
See application file for complete search history.

(56) References Cited

U.S. PATENT DOCUMENTS 3,864,970 A 2/1975 Bell (Continued)

FOREIGN PATENT DOCUMENTS

GB 2355740 A 2/2001

(Continued)

OTHER PUBLICATIONS

Hamid, Syed, Lester, G. Scott and Adkins, Darrell W.; A Fiber-Optic Inspection System for Prepacked Screens; Society of Petroleum Engineers Inc.; pp. 1-12.

(Continued)

*Primary Examiner*—William Neuder
(74) *Attorney, Agent, or Firm*—Van Someren, P.C.; Kevin P. McEnaney; Jaime A. Castano

(57) ABSTRACT

A well system utilizes a control line system. The control line system is implemented with a completion of the type deployed in a wellbore. The control line system facilitates transmission of monitoring, command or other types of control and telemetry. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 CFR 1.72(b).

65 Claims, 31 Drawing Sheets

U.S. PATENT DOCUMENTS

| | | | | |
|---|---|---|---|---|
| 4,375,164 | A | 3/1983 | Dodge et al. | |
| 4,783,995 | A | 11/1988 | Michel et al. | |
| 4,945,991 | A | 8/1990 | Jones | |
| 4,976,142 | A | 12/1990 | Perales | |
| 5,163,321 | A | 11/1992 | Perales | |
| 5,186,255 | A | 2/1993 | Corey | |
| 5,350,018 | A | 9/1994 | Sorem et al. | |
| 5,485,745 | A | 1/1996 | Rademaker et al. | |
| 5,515,915 | A | 5/1996 | Jones et al. | |
| 5,517,593 | A | 5/1996 | Nenniger et al. | |
| 5,579,842 | A | 12/1996 | Riley | |
| 5,690,171 | A | 11/1997 | Winch et al. | |
| 5,844,927 | A | 12/1998 | Kringlebotn | |
| 5,890,533 | A | 4/1999 | Jones | |
| 5,925,879 | A | 7/1999 | Hay | |
| 5,938,925 | A | 8/1999 | Hamid et al. | |
| 6,041,860 | A | 3/2000 | Nazzal et al. | |
| 6,065,535 | A | 5/2000 | Ross | |
| 6,065,538 | A | 5/2000 | Reimers et al. | |
| 6,125,933 | A | 10/2000 | Ross | |
| 6,173,788 | B1 | 1/2001 | Lembcke et al. | |
| 6,186,229 | B1 | 2/2001 | Martin et al. | |
| 6,192,983 | B1 | 2/2001 | Neuroth et al. | |
| 6,209,640 | B1 | 4/2001 | Reimers et al. | |
| 6,220,353 | B1 | 4/2001 | Foster et al. | |
| 6,253,856 | B1 | 7/2001 | Ingram et al. | |
| 6,279,392 | B1 | 8/2001 | Shahin, Jr. et al. | |
| 6,281,489 | B1 | 8/2001 | Tubel et al. | |
| 6,292,066 | B1 | 9/2001 | Shibuya et al. | |
| 6,296,056 | B1 | 10/2001 | Ward | |
| 6,302,204 | B1 | 10/2001 | Reimers et al. | |
| 6,325,146 | B1 | 12/2001 | Ringgenberg et al. | |
| 6,343,651 | B1 | 2/2002 | Bixenman | |
| 6,359,569 | B2 | 3/2002 | Beck et al. | |
| 6,446,729 | B1 | 9/2002 | Bixenman et al. | |
| 6,505,682 | B2 | 1/2003 | Brockman | |
| 6,513,599 | B1 * | 2/2003 | Bixenman et al. | 166/378 |
| 2001/0020675 | A1 | 9/2001 | Tubel et al. | |
| 2002/0007948 | A1 | 1/2002 | Bayne et al. | |
| 2003/0196820 | A1 * | 10/2003 | Patel | 166/387 |
| 2005/0044690 | A1 * | 3/2005 | Gillespie et al. | 29/521 |

FOREIGN PATENT DOCUMENTS

| | | |
|---|---|---|
| WO | WO 98/50673 | 11/1998 |
| WO | WO 98/50680 | 11/1998 |
| WO | WO99/45235 | 9/1999 |
| WO | WO 01/33032 A1 | 5/2001 |
| WO | WO 01/65067 | 9/2001 |
| WO | WO01/92680 | 12/2001 |
| WO | WO02/06593 | 1/2002 |
| WO | WO02/06625 | 1/2002 |

OTHER PUBLICATIONS

Docket Sheet for *Memry Corporation* v. *Kentucky Oil Technology*, N.V., Case No. H-04-1959 (S.D. Tex.) (PACER Jun. 2, 2005) (5 pages).

Docket Sheet for *Memry Corporation* v. *Kentucky Oil Technology*, N.V., Case No. C-04-03843, (N.D. Cal.) (PACER Aug. 11, 2005) (13 pages).

Communication from United States District Court Transferring Case, *Memry Corporation* v. *Kentucky Oil Technology*, N.V., Case No. H-04-1959 (S.D. Tex.), dated Sep. 7, 2004 (1 page).

Plaintiffs' Original Complaint, *Memry Corporation* v. *Kentucky Oil Technology*, N.V., Case No. H-04-1959, (S.D. Tex.), filed May 14, 2004 (20 pages).

Defendants' Motions (1) to Dismiss the Complaint for Insufficiency of Process and Lack of Personal Jurisdiction, (2) to Dismiss Counts I-III of the Complaint for Failure to State a Claim, and (3) in the Alternative, to Transfer This Action to the Federal District Court for the Northern District of California, *Memry Corporation* v. *Kentucky Oil Technology*, N.V., Case No. H-04-1959, (S.D. Tex.), filed Jul. 7, 2004 (49 pages).

Plaintiff's First Amended Complaint, *Memry Corporation* v. *Kentucky Oil Technology*, N.V., Case No. C-04-03843, (N.D. Cal.), filed Aug. 19, 2004 (20 pages).

Answer of Defendants and Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.) filed Nov. 2, 2004 (20 pages).

Plaintiff and Counterdefendant Memry Corporation's Answer to Kentucky Oil Technology N.V.'s Counterclaims and Demand for Jury Trial, *Memry Corporation* v. *Kentucky Oil Technology*, N.V., Case No. C-04-03843, (N.D. Cal.), filed Dec. 3, 2004 (10 pages).

Schlumberger Technology Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Jan. 24, 2005 (32 pages).

[Proposed]Order Granting Schlumberger Technology Corporation's Motion to Dismiss Kentucky Oil Technology's Third, Fourth, Fifth, and Sixth Counterclaims, *Memry Corporation*, v. *Kentucky Oil Technology*, N.V., Case No. C-04-03843, (N.D. Cal.), filed Jan. 24, 2005 (3 pages).

First Amended Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.), filed Feb. 9, 2005 (16 pages).

Schlumberger Technology Corporation's Notice of Motion and Motion to Dismiss Kentucky Oil Technology's First Amended Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Feb. 24, 2005 (32 pages).

Request for Judicial Notice in Support of Schlumberger Technology Corporation's Motion to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Feb. 24, 2005 (3 pages).

[Proposed] Order Granting Schlumberger Technology Corporation's Motion to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Feb. 24, 2005 (3 pages).

Plaintiff and Counterdefendant Memry Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Feb. 25, 2005 (29 pages).

Request for Judicial Notice in Support of Memry Corporation's Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Feb. 25, 2005 (3 pages).

[Proposed] Order Granting Memry Corporation's Motion to Dismiss Kentucky Oil Technology's Third Fourth, Fifth, and Sixth Counterclaims, *Memry Corporation* v. *Kentucky Oil Technology*, N.V., Case No. C-04-03843, (N.D. Cal.), filed Feb. 25, 2005 (3 pages).

Opposition of Kentucky Oil to Motions of Memry Corporation and Schlumberger Technology Corporation to Dismiss First Amended Counterclaims, *Memry Corporation* v. *Kentucky Oil Technology*, N.V., Case No. C-04-03843, (N.D. Cal.), filed Mar. 11, 2005 (29 pages).

Kentucky Oil's Opposition to Counterdefendants' Requests for Judicial Notice in Support of Their Motions to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Mar. 11, 2005 (3 pages).

Plaintiff and Counterdefendant Memry Corporation's Reply in Support of Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Mar. 18, 2005 (9 pages).
Plaintiff and Counterdefendant Memry Corporation's Reply in Support of Request for Judicial Notice, *Memry Corporation* v. *Kentucky Oil Technology*, N.V., Case No. C-04-03843, (N.D. Cal.), filed Mar. 18, 2005 (4 pages).
Reply of Schlumberger Technology Corporation to Kentucky Oil Technology's Opposition to First Amended, Third, Fourth, Fifth, and Sixth Counterclaims, *Memry Corporation* v. *Kentucky Oil Technology*, N.V., Case No. C-04-03843, (N.D. Cal.), filed Mar. 18, 2005 (17 pages).
Schlumberger's Response to Kentucky Oil's Opposition to Counterdefendants' Requests for Judicial Notice, *Memry Corporation* v. *Kentucky Oil Technology*, N.V., Case No. C-04-03843, (N.D. Cal.), filed Mar. 18, 2005 (3 pages).
Schlumberger's Notice of Motion and Motion to Strike Exhibits 1, 2, and 4 to the Declaration of Nicola A. Pisano, *Memry Corporation* v. *Kentucky Oil Technology*, N.V., Case No. C-04-03843, (N.D. Cal.), filed Mar. 18, 2005 (3 pages).
Kentucky Oil's Opposition to STC's Motion to Strike Exhibits 1, 3 and 4 to the Declaration of Nicola A. Pisano, *Memry Corporation* v. *Kentucky Oil Technology*, N.V., Case No. C-04-03843, (N.D. Cal.), filed Mar. 25, 2005 (3 pages).
Kentucky Oil's Notice of Motion and Motion to Strike Declaration of Benjamin Holl and Portions of Counterdefendants' Reply Briefs, *Memry Corporation* v. *Kentucky Oil Technology*, N.V., Case No. C-04-03843, (N.D. Cal.), filed Mar. 25, 2005 (4 pages).
[Proposed] Order Granting Kentucky Oil's Motion to Strike Declaration of Benjamin Holl and Portions of Counterdefendants' Reply Briefs, *Memry Corporation* v. *Kentucky Oil Technology*, N.V., Case No. C-04-03843, (N.D. Cal.), entered Mar. 25, 2005 (2 pages).
Order Granting in Part and Denying in Part Counterdefendants' Motion to Dismiss, *Memry Corporation* v. *Kentucky Oil Technology*, N.V., Case No. C-04-03843, (N.D. Cal.), entered Apr. 8, 2005 (26 pages).
Plaintiff and Counterdefendant Memry Corporation's Reply to Kentucky Oil Technology N.V.'s Counterclaims and Demand for Jury Trial, *Memry Corporation* v. *Kentucky Oil Technology*, N.V., Case No. C-04-03843, (N.D. Cal.), filed Apr. 18, 2005 (8 pages).
Second Amended Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.), filed May 6, 2005 (20 pages).
Plaintiff Memry Corporation's Reply to Kentucky Oil Technology N.V.'s Second Amended Counterclaims and Demand for Jury Trial, *Memry Corporation* v. *Kentucky Oil Technology*, N.V., Case No. C-04-03843, (N.D. Cal.), filed Jun. 3, 2005 (9 pages).
Schlumberger Technology Corporation's Notice of Motion and Motion to Dismiss the Fourth, Fifth, Sixth, Seventh and Eighth Counterclaims in Kentucky Oil Technology's Second Amended Counterclaims, *Memry Corporation* v. *Kentucky Oil Technology*, N.V., Case No. C-04-03843, (N.D. Cal.), filed Jun. 3, 2005 (18 pages).
Opposition of Kentucky Oil Technology to Schlumberger Technology Corporation's Motion to Dismiss Kentucky Oil's Second Amended Counterclaims, *Memry Corporation* v. *Kentucky Oil Technology*, N.V., Case No. C-04-03843, (N.D. Cal.), filed Jun. 17, 2005 (16 pages).
Schlumberger Technology Corporation's Reply Brief in Support of its Motion to Dismiss the Fourth, Fifth, Sixth, Seventh and Eighth Counterclaims in Kentucky Oil Technology's Second Amended Counterclaims, *Memry Corporation* v. *Kentucky Oil Technology*, N.V., Case No. C-04-03843, (N.D. Cal.), filed Jun., 24, 2005 (11 pages).
Order Granting in Part and Denying In Part STC's Motion to Dismiss, *Memry Corporation* v. *Kentucky Oil Technology*, N.V., Case No. C-04-03843, (N.D. Cal.), entered Jul. 14, 2005 (8 pages).
Schlumberger Technology Corporation's Answer to Kentucky Oil Technology's Second Amended Counterclaims, *Memry Corporation* v. *Kentucky Oil Technology*, N.V., Case No. C-04-03843, (N.D. Cal.), filed Jul., 28, 2005 (8 pages).
Notice o Motion and Motion by Kentucky Oil To Compel Production of Documents by Schlumberger Technology Corporation Pursuant to Fed. R. Civ. Rule 37; Memorandum of Points and Authorities in Support Thereof; Declaration of Michael Bierman, *Memry Corporation* v. *Kentucky Oil Technology*, N.V., Case No. C-04-03843, (N.D. Cal.), filed Jul. 28, 1005 (32 pages).
Schlumberger Technology Corporation's Opposition to Kentucky Oil Technology's Motion to Compel, *Memry Corporation* v. *Kentucky Oil Technology*, N.V., Case No. C-04-03843, (N.D. Cal.), filed Aug. 4, 2005 (21 pages).
Declaration of David B. Moyer in Support of Schlumberger Technology Corporation's Opposition to Kentucky Oil Technology's Motion to Compel, *Memry Corporation* v. *Kentucky Oil Technology*, N.V., Case No. C-04-03843, (N.D. Cal.), filed Aug. 4, 2005 (52 pages).
Kentucky Oil's Reply in Support of Motion to Compel, *Memry Corporation* v. *Kentucky Oil Technology*, N.V., Case No. C-04-03843, (N.D. Cal.), filed Aug. 10, 2005 (18 pages).
Declaration of Nicola A. Pisano in Support of Kentucky Oil's Motion to Compel, *Memry Corporation* v. *Kentucky Oil Technology*, N.V., Case No. C-04-03843, (N.D. Cal.), filed Aug. 10, 2005 (69 pages).
Order Granting Kentucky Oil's Motion to Compel Production of Documents, *Memry Corporation* v. *Kentucky Oil Technology*, N.v., Case No. C-04-03843, (N.D. Cal.), entered Aug. 17, 2005 (8 pages).

* cited by examiner

WELL COMMUNICATION SYSTEM

CROSS-REFERENCE TO RELATED APPLICATION

This is a continuation-in-part of U.S. Ser. No. 10/125,447, filed Apr. 18, 2002 now U.S. Pat. No. 6,789,510 which was a continuation-in-part of U.S. Ser. No. 10/021,724 filed Dec. 12, 2001 now U.S. Pat. No. 6,695,054; U.S. Ser. No. 10/079,670, filed Feb. 20, 2002 now U.S. Pat. No. 6,848,510; U.S. Ser. No. 09/981,072, filed Oct. 16, 2001; U.S. Ser. No. 09/973,442, filed Oct. 9, 2001 now U.S. Pat. No. 6,799,637; U.S. Ser. No. 09/732,134, filed Dec. 7, 2000 now U.S. Pat. No. 6,446,729. The present application also is based upon and claims priority to U.S. provisional application Ser. No. 60/432,343, filed Dec. 10, 2002; U.S. Provisional application Ser. No. 60/418,487, filed Oct. 15, 2002; and U.S. provisional application Ser. No. 60/407,078, field Aug. 30, 2002.

BACKGROUND

1. Field of Invention

The present invention relates to the field of well monitoring. More specifically, the invention relates to well equipment and methods utilizing control line systems for monitoring of wells and for well telemetry.

2. Related Art

There is a continuing need to improve the efficiency of producing hydrocarbons and water from wells. One method to improve such efficiency is to provide monitoring of the well so that, for example, adjustments may be made to improve well efficiency. Accordingly, there is a continuing need to provide such systems.

SUMMARY

Embodiments of the present invention provide systems and methods for use in connection with wells. The systems and methods utilize monitoring and telemetry to facilitate various well treatments, data gathering and other well based operations.

BRIEF DESCRIPTION OF THE DRAWINGS

The manner in which these objectives and other desirable characteristics can be obtained is explained in the following description and attached drawings in which.

It is to be noted, however, that the appended drawings illustrate only embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In this description, the terms "up" and "down"; "upward" and downward"; "upstream" and "downstream"; and other like terms indicating relative positions above or below a given point or element are used in this description to more clearly described some embodiments of the invention. However, when applied to apparatus and methods for use in wells that are deviated or horizontal, such terms may refer to a left to right, right to left, or other relationship as appropriate.

Figure 1:
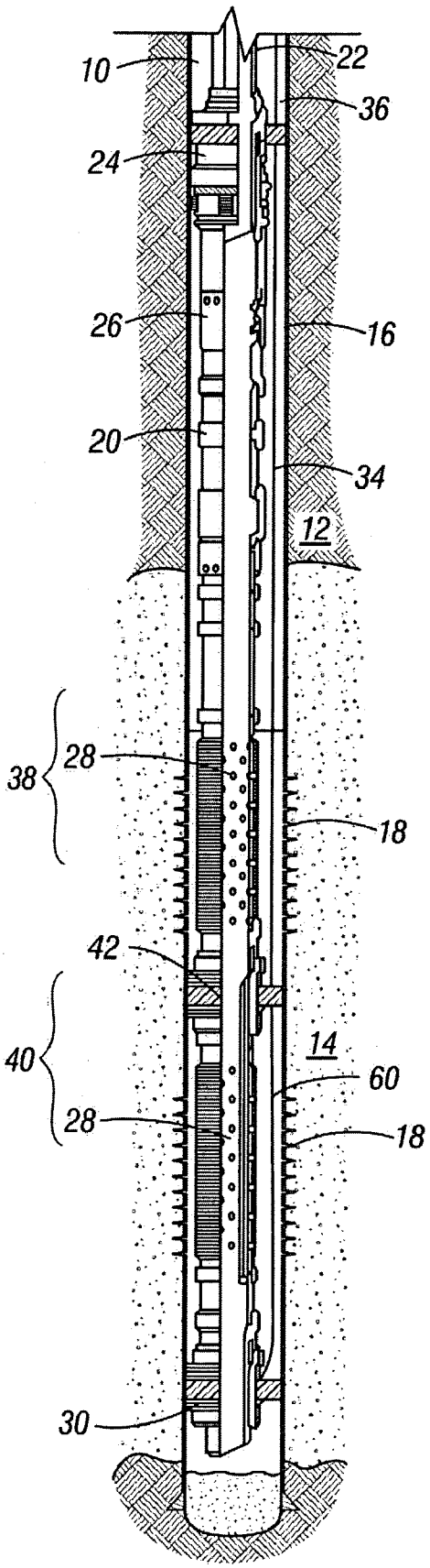
FIG. 1 illustrates a well having a gravel pack completion with a control line therein.

One aspect of the present invention is the use of a sensor, such as a fiber optic distributed temperature sensor, in a well to monitor an operation performed in the well, such as a gravel pack as well as production from the well. Other aspects comprise the routing of control lines and sensor placement in a sand control completion. Referring to the attached drawings, FIG. 1 illustrates a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20, such as a sand control completion, is positioned within the casing 16 in a position adjacent to the productive formation 14, which is to be gravel packed.

The present invention can be utilized in both cased wells and open hole completions. For ease of illustration of the relative positions of the producing zones, a cased well having perforations will be shown.

In the illustrated sand control completion, the well tool 20 comprises a tubular member 22 attached to a production packer 24, a cross-over 26, and one or more screen elements 28. The tubular member 22 can also be referred to as a tubing string, coiled tubing, workstring or other terms well known in the art. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string. FIG. 1 shows an optional lower packer 30 located below the perforations 18.

In a gravel pack operation the packer element 24 is set to ensure a seal between the tubular member 22 and the casing 16. Gravel laden slurry is pumped down the tubular member 22, exits the tubular member through ports in the cross-over 26 and enters the annulus area 34. Slurry dehydration occurs when the carrier fluid leaves the slurry. The carrier fluid can leave the slurry by way of the perforations 18 and enter the formation 14. The carrier fluid can also leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack. In this example, an upper zone 38 and a lower zone 40 are each perforated and gravel packed. An isolation packer 42 is set between them.

As used herein, the term "screen" refers to wire wrapped screens, mechanical type screens and other filtering mechanisms typically employed with sand screens. Screens generally have a perforated base pipe with a filter media (e.g., wire wrapping, mesh material, pre-packs, multiple layers, woven mesh, sintered mesh, foil material, wrap-around slotted sheet, wrap-around perforated sheet, MESHRITE manufactured by Schlumberger, or a combination of any of these media to create a composite filter media and the like) disposed thereon to provide the necessary filtering. The filter media may be made in any known manner (e.g., laser cutting, water jet cutting and many other methods). Sand screens have openings small enough to restrict gravel flow, often having gaps in the 60–120 mesh range, but other sizes may be used. The screen element 28 can be referred to as a screen, sand screen, or a gravel pack screen. Many of the common screen types include a spacer that offsets the screen member from a perforated base tubular, or base pipe, that the screen member surrounds. The spacer provides a fluid flow annulus between the screen member and the base tubular. Screens of various types are commonly known to those skilled in the art. Note that other types of screens will be discussed in the following description. Also, it is understood that the use of other types of base pipes, e.g. slotted pipe, remains within the scope of the present invention. In addition, some screens 28 have base pipes that are imperforated along their length or a portion thereof to provide for routing of fluid in various manners and for other reasons.

Figure 2:
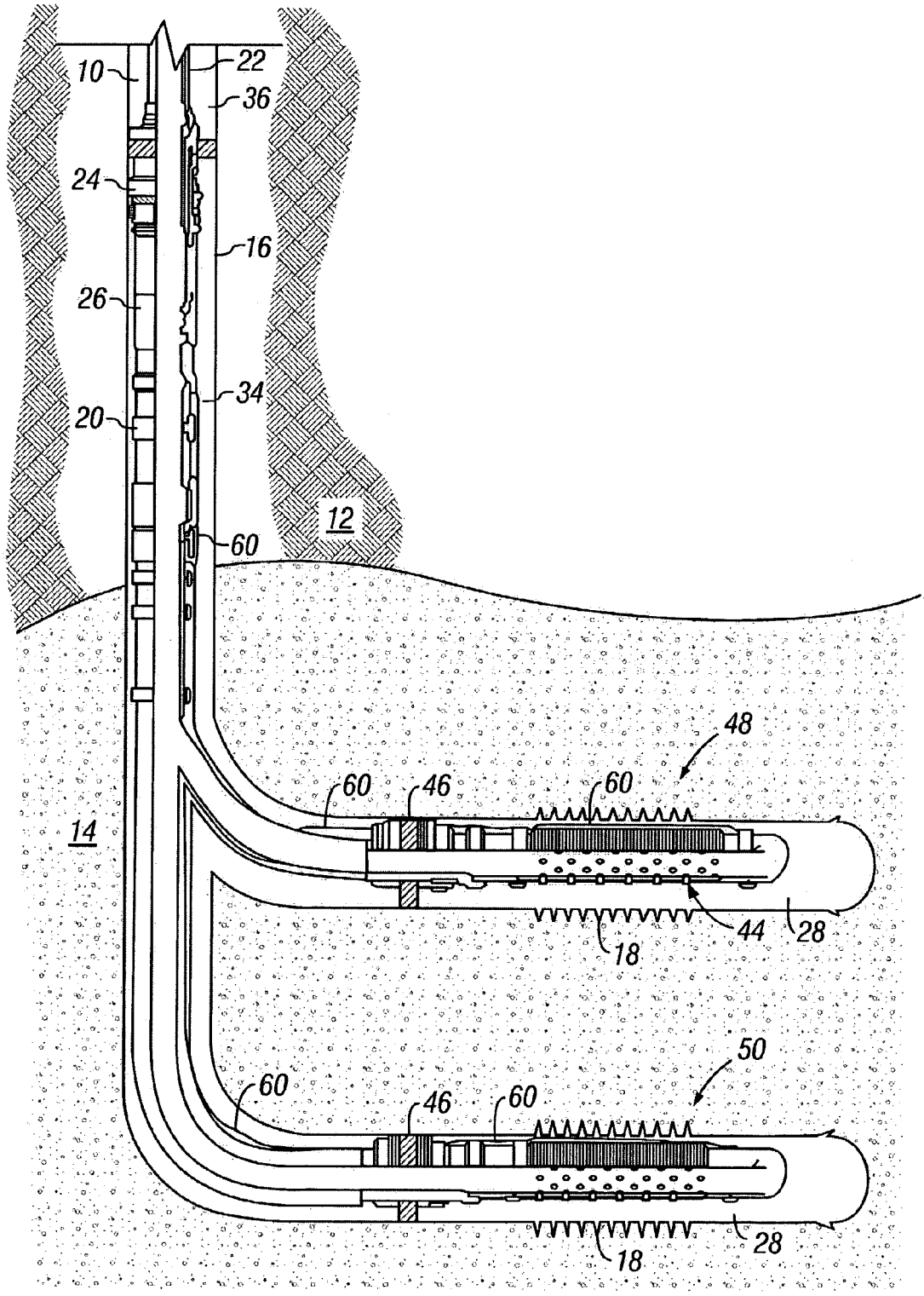
FIG. 2 illustrates a multilateral well having a gravel packed lateral and control lines extending into both laterals.

Note that numerous other types of sand control completions and gravel pack operations are possible and the above described completion and operation are provided for illustration purposes only. As an example, FIG. 2 illustrates one particular application of the present invention in which two lateral wellbores are completed, an upper lateral 48 and a lower lateral 50. Both lateral wellbores are completed with a gravel pack operation comprising a lateral isolation packer 46 and a sand screen assembly 28.

Figure 3:
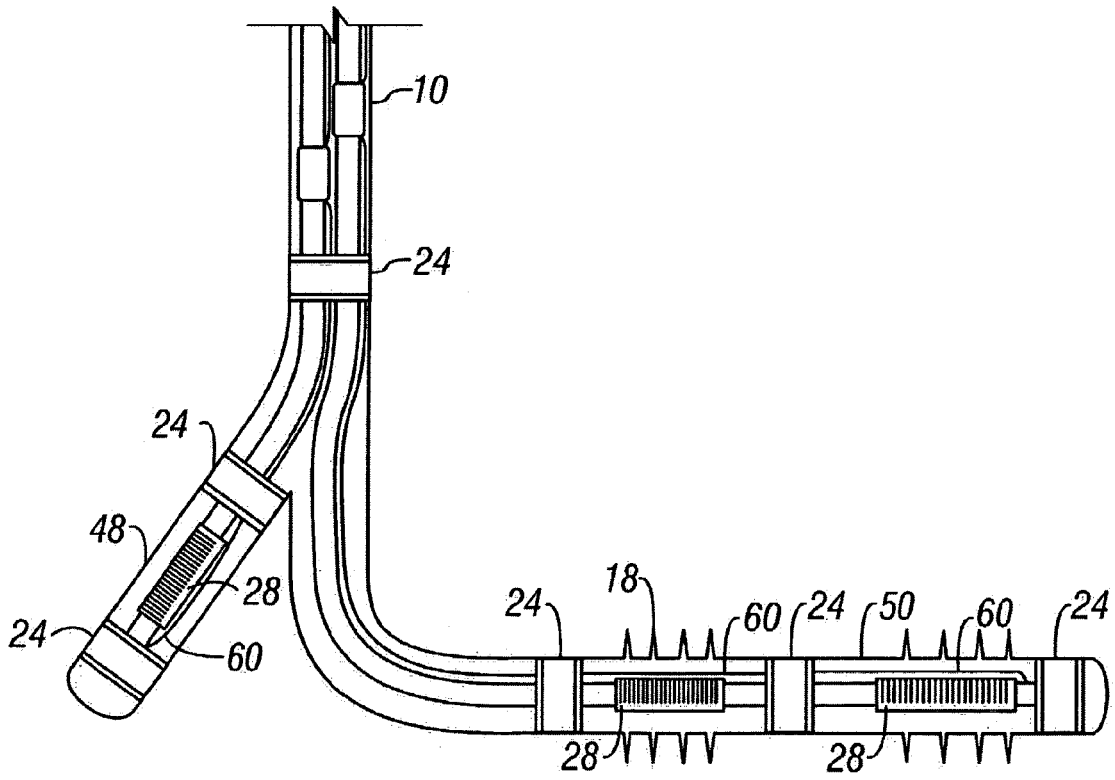
FIG. 3 illustrates a multilateral well having a plurality of zones in one of the laterals and sand face completions with control lines extending therein.

Similarly, FIG. 3 shows another exemplary embodiment in which two laterals are completed with a sand control completion and a gravel pack operation. The lower lateral 50 in FIG. 3 has multiple zones isolated from one another by a packer 42.

In each of the examples shown in FIGS. 1 through 3, a control line 60 extends into the well and is provided adjacent to the screen 28. Although shown with the control line 60 outside the screen 28, other arrangements are possible as disclosed herein. Note that other embodiments discussed herein will also comprise intelligent completions devices 62 in the gravel pack, the screen 28, or the sand control completion.

Examples of control lines 60 are electrical, hydraulic, fiber optic and combinations of thereof. Note that the communication provided by the control lines 60 may be with downhole controllers rather than with the surface and the telemetry may include wireless devices and other telemetry devices such as inductive couplers and acoustic devices. In addition, the control line itself may comprise an intelligent completions device as in the example of a fiber optic line that provides functionality, such as temperature measurement (as in a distributed temperature system), pressure measurement, sand detection, seismic measurement, and the like.

Examples of intelligent completions devices that may be used in the connection with the present invention are gauges, sensors, valves, sampling devices, a device used in intelligent or smart well completion, temperature sensors, pressure sensors, flow-control devices, flow rate measurement devices, oil/water/gas ratio measurement devices, scale detectors, actuators, locks, release mechanisms, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, perforating devices, shape charges, firing heads, locators, and other downhole devices. In addition, the control line itself may comprise an intelligent completions device as mentioned above. In one example, the fiber optic line provides a distributed temperature functionality so that the temperature along the length of the fiber optic line may be determined.

Figure 4:
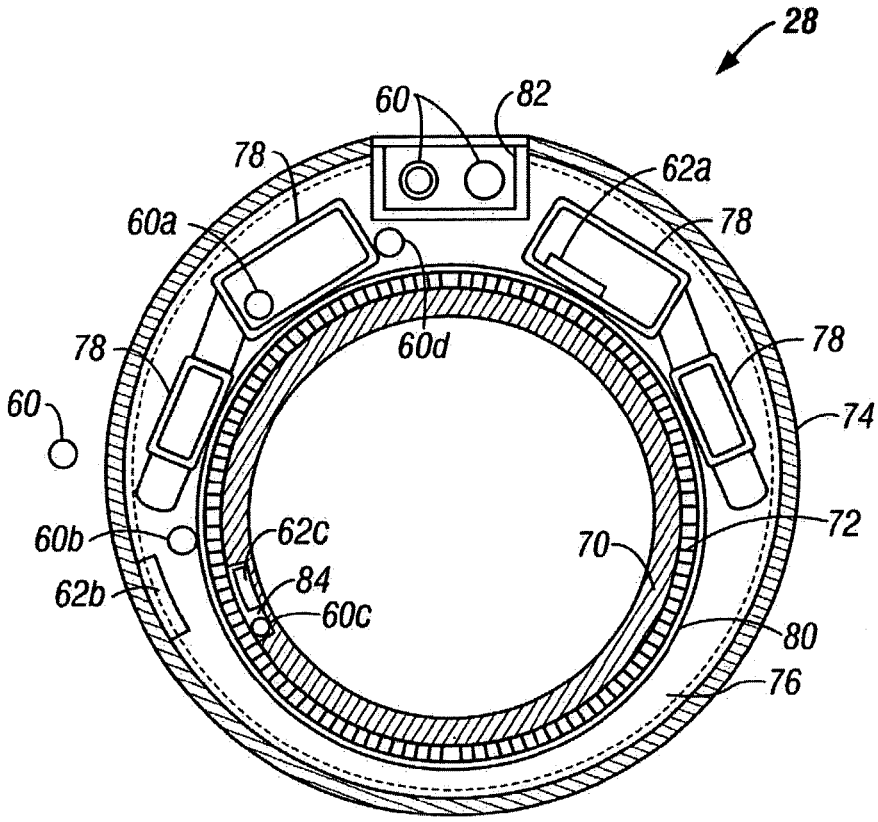
FIG. 4 is a cross sectional view of a sand screen used in an embodiment of the present invention.

FIG. 4 is a cross sectional view of one embodiment of a screen 28 of the present invention. The sand screen 28 generally comprises a base pipe 70 surrounded by a filter media 72. To provide for the flow of fluid into the base pipe 70, it has perforations therethrough. The screen 28 is typical to those used in wells such as those formed of a screen wrap or mesh designed to control the flow of sand therethrough. Surrounding at least a portion of the base pipe 70 and filter media 72 is a perforated shroud 74. The shroud 74 is attached to the base pipe 70 by, for example, a connecting ring or other connecting member extending therebetween and connected by a known method such as welding. The shroud 74 and the filter media 72 define a space therebetween 76.

In the embodiment shown in FIG. 4, the sand screen 28 comprises a plurality of shunt tubes 78 (also known as alternate paths) positioned in the space 76 between the screen 28 and the shroud 74. The shunt tubes 78 are shown attached to the base pipe 70 by an attachment ring 80. The methods and devices of attaching the shunt tubes 78 to the base pipe 70 may be replaced by any one of numerous equivalent alternatives, only some of which are disclosed in the specification. The shunt tubes 78 can be used to transport gravel laden slurry during a gravel pack operation, thus reducing the likelihood of gravel bridging and providing improved gravel coverage across the zone to be gravel packed. The shunt tubes 78 can also be used to distribute treating fluids more evenly throughout the producing zone, such as during an acid stimulation treatment.

The shroud 74 comprises at least one channel 82 therein. The channel 82 is an indented area in the shroud 74 that extends along its length linearly, helically, or in other traversing paths. The channel 82 in one alternative embodiment has a depth sufficient to accommodate a control line 60 therein and allow the control line 60 to not extend beyond the outer diameter of the shroud 74. Other alternative embodiments may allow a portion of the control line 60 to extend from the channel 82 and beyond the outer diameter of the shroud 74 without damaging the control line 60. In another alternative, the channel 82 includes an outer cover (not shown) that encloses at least a portion of the channel 82. To protect the control line 60 and maintain it in the channel 82, the sand screen 28 may comprise one or more cable protectors, or restraining elements, or clips.

FIG. 4 also shows other alternative embodiments for routing of control lines 60 and for placement of intelligent completions devices 62 such as sensors therein. As shown in previous figures, the control line 60 may extend outside of the sand screen 28. In one alternative embodiment, a control line 60*a* extends through one or more of the shunt tubes 78. In another embodiment, the control line 60*b* is placed between the filter media 72 and the shroud 74 in the space 76. FIG. 4 shows another embodiment in which a sensor 62*a* is placed in a shunt tube 78 as well as a sensor 62*b* attached to the shroud 74. Note that an array of such sensors 62*a* may be placed along the length of the sand screen 28. In another alternative embodiment, the base pipe 70 may have a passageway 84, or groove, therein through which a control line 60*c* may extend and in which an intelligent completions device 62*c* may be placed. The passageway 84 may be placed internally in the base pipe 70, on an inner surface of the base pipe 70, or on an outer surface of the base pipe 70 as shown in FIG. 4.

Figure 5:
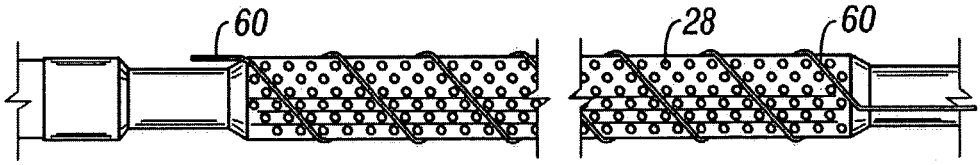
FIG. 5 is a side elevational view of a sand screen showing a helical routing of a control line along the sand screen.

The control line 60 may extend the full length of the screen 28 or a portion thereof. Additionally, the control line 60 may extend linearly along the screen 28 or follow an arcuate path. FIG. 5 illustrates a screen 28 having a control line 60 that is routed in a helical path along the screen 28. In one embodiment, the control line 60 comprises a fiber optic line that is helically wound about the screen 28 (internal or external to the screen 28) to increase resolution at the screen. In this embodiment, a fiber optic line comprises a distributed temperature system. Other paths about the screen 28 that increase the length of the fiber optic line per longitudinal unit of length of screen 28 will also serve to increase the resolution of the functionality provided by the fiber optic line.

Figure 6:
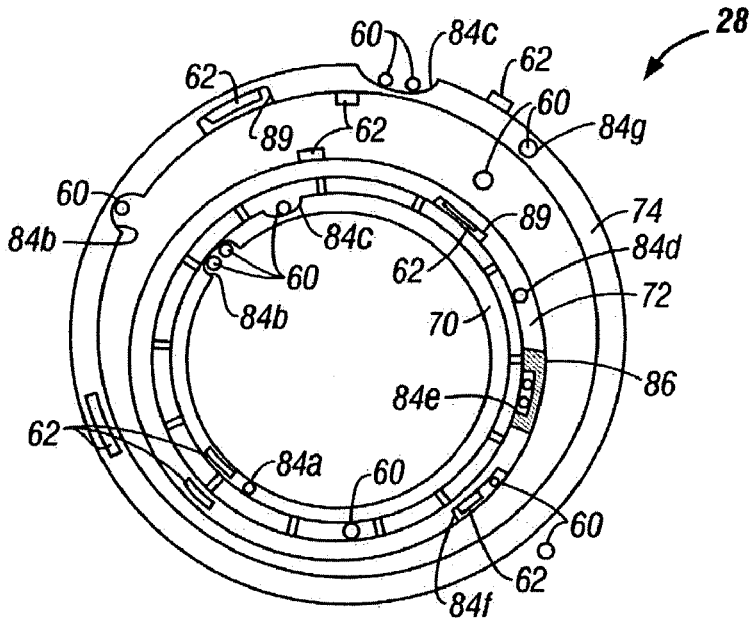
FIGS. 6 through 8 are cross sectional views of a sand screen showing numerous alternative designs.
Figure 7:
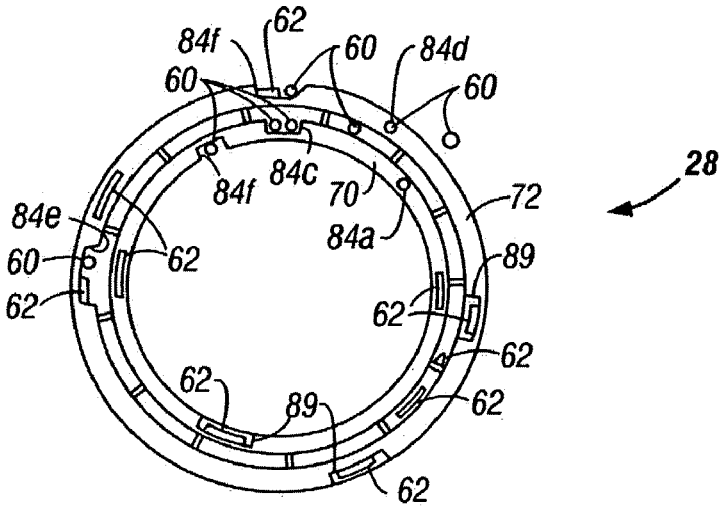

FIGS. 6 and 7 illustrate a number of alternative embodiments for placement of control lines 60 and intelligent completions device 62. FIG. 6 shows a sand screen 28 that has a shroud 74, whereas the embodiment of FIG. 7 does not have a shroud 74.

In both FIGS. 6 and 7, the control line 60 may be routed along the base pipe 70 via an internal passageway 84*a*, a passageway 84*b* formed on an internal surface of the base pipe 70, or a passageway 84*c* formed on an external surface of the base pipe 70. In one alternative embodiment, the base pipe 70 (or a portion thereof) is formed of a composite material. In other embodiments, the base pipe 70 is formed of a metal material. Similarly, the control line 60 may be routed along the filter media 72 through an internal passageway 84*d*, a passageway 84*e* formed on an internal surface of the filter media 72, or a passageway 84*f* formed on an external surface of the filter media 72. Likewise, the control line 60 may be routed along the shroud 74 through an internal passageway 84*g*, a passageway 84*h* formed on an internal surface of the shroud 74, or a passageway 84*i* formed on an external surface of the shroud 74. The shroud 74 may be formed of a metal or composite material. In addition, the control line 60 may also extend between the base pipe 70 and the filter media 72, between the filter media 72 and the shroud 74, or outside the shroud 74. In one alternative embodiment, the filter media has an impermeable portion 86, through which flow is substantially prevented, and the control line 60 is mounted in that portion 86. Additionally, the control line 60 may be routed through the shunt tubes 78 or along the side of the shunt tubes 78 (60*d* in FIG. 4). Combinations of these control line 60 routes may also be used (e.g., a particular device may have control lines 60 extending through a passageway formed in the base pipe 70 and through a passageway formed in the shroud 74). Each position has certain advantages and may be used depending upon the specific application.

Likewise, FIGS. 6 and 7 show a number of alternatives for positioning of an intelligent completions device 62 (e.g., a sensor). In short, the intelligent completions device 62 may be placed within the walls of the various components (e.g., the base pipe 70, the filter media 72, the shroud 74 and, the shunt tube 78), on an inner surface or outer surface of the components (70, 72, 74, 78), or between the components (70, 72, 74, 78). Also, the components may have recesses 89 formed therein to house the intelligent completions device 62. Each position has certain advantages and may be used depending upon the specific application.

Figure 8:
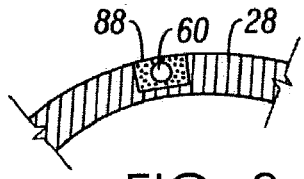

In the alternative embodiment of FIG. 8, the control line 60 is placed in a recess in one of the components (70, 72, 74, 78). A material filler 88 is placed in the recess to mold the control line in place. As an example, the material filler 88 may be an epoxy, a gel that sets up, or other similar material. In one embodiment, the control line 60 is a fiber optic line that is molded to, or bonded to, a component (70, 72, 74, 78) of the screen 28. In this way, the stress and/or strain applied to the screen 28 may be detected and measured by the fiber optic line. Further, the fiber optic line may provide seismic measurements when molded to the screen 28 (or other downhole component or equipment) in this way.

In addition to conventional sand screen completions, the present invention is also useful in completions that use expandable tubing and expandable sand screens. As used herein an expandable tubing 90 comprises a length of expandable tubing. The expandable tubing 90 may be a solid expandable tubing, a slotted expandable tubing, an expandable sand screen, or any other type of expandable conduit. Examples of expandable tubing are the expandable slotted liner type disclosed in U.S. Pat. No. 5,366,012, issued Nov. 22, 1994 to Lohbeck, the folded tubing types of U.S. Pat. No. 3,489,220, issued Jan. 13, 1970 to Kinley, U.S. Pat. No. 5,337,823, issued Aug. 16, 1994 to Nobileau, U.S. Pat. No. 3,203,451, issued Aug. 31, 1965 to Vincent, the expandable sand screens disclosed in U.S. Pat. No. 5,901,789, issued May 11, 1999 to Donnelly et al., U.S. Pat. No. 6,263,966, issued Jul. 24, 2001 to Haut et al., PCT Application No. WO 01/20125 A1, published Mar. 22, 2001, U.S. Pat. No. 6,263,972, issued Jul. 24, 2001 to Richard et al., as well as the bi-stable cell type expandable tubing disclosed in U.S. patent application Ser. No. 09/973,442, filed Oct. 9, 2001. Each length of expandable tubing may be a single joint or multiple joints.

Figure 9:
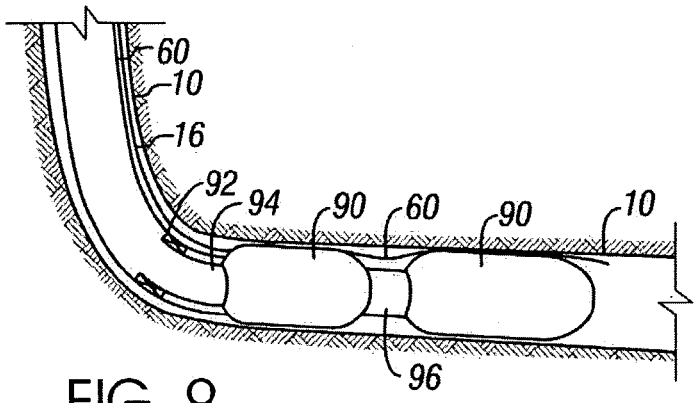
FIGS. 9 and 10 illustrate wells having expandable tubings and control lines therein.

Referring to FIG. 9, a well 10 has a casing 16 extending to an open-hole portion. At the upper end of the expandable tubing 90 is a hanger 92 connecting the expandable tubing 90 to a lower end of the casing 16. A crossover section 94 connects the expandable tubing 90 to the hanger 92. However, other known methods of connecting an expandable tubing 90 to a casing 16 may be used, or the expandable tubing 90 may remain disconnected from the casing 16. FIG. 9 is but one illustrative embodiment. In one embodiment, the expandable tubing 90 (connected to the crossover section 94) is connected to another expandable tubing 90 by an unexpanded, or solid, tubing 96. The unexpanded tubing is provided for purposes of illustration only and other completions may omit the unexpanded tubing 96. A control line 60 extends from the surface and through the expandable tubing completion. FIG. 9 shows the control line 60 on the outside of the expandable tubing 90 although it could run through the wall of the expandable tubing 90 or internal to the expandable tubing 90. In one embodiment, the control line 60 is a fiber optic line that is bonded to the expandable tubing 90 and used to monitor the expansion of the expandable tubing 90. For example, the fiber optic line could measure the temperature, the stress, and/or the strain applied to the expandable tubing 90 during expansion. Such a system would also apply to a multilateral junction that is expanded. If it is determined, for example, that the expansion of the expandable tubing 90 or a portion thereof is insufficient (e.g., not fully expanded), a remedial action may be taken. For example, the portion that is not fully expanded may be further expanded in a subsequent expansion attempt, also referred to as reexpanded.

In addition, the control line 60 or intelligent completions device 62 provided in the expandable tubing may be used to measure well treatments (e.g., gravel pack, chemical injection, cementing) provided through or around the expandable tubing 90.

Figure 10:
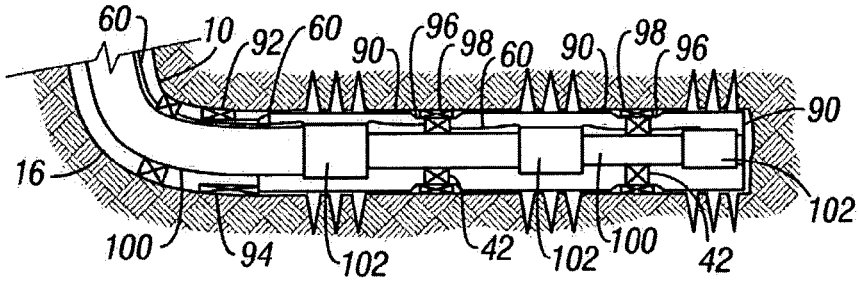

FIG. 10 illustrates an alternative embodiment of the present invention in which a plurality of expandable tubings 90 are separated by unexpanded tubing sections 96. As in the embodiment of FIG. 9, the expandable tubing 90 is connected to the casing 16 of the well 10 by a hanger 92 (which may be a packer). The expandable tubing sections 90 are aligned with separate perforated zones and expanded. Each of the unexpanded tubing sections 96 has an external casing packer 98 (also referred to generally herein as a "seal") thereon that provides zonal isolation between the expandable tubing sections 90 and associated zones. Note that the external casing packer 98 may be replaced by other seals 28 such as an inflate packer, a formation packer, and or a special elastomer or resin. A special elastomer or resin refers to an elastomer or resin that undergoes a change when exposed to the wellbore environment or some other chemical to cause the device to seal. For example, the elastomer may absorb oil to increase in size or react with some injected chemical to form a seal with the formation. The elastomer or resin may react to heat, water, or any method of chemical intervention.

In one embodiment the expandable tubing sections 90 are expandable sand screens and the expandable completion provides a sand face completion with zonal isolation. The expandable tubing sections and the unexpanded tubing sections may be referred to generally as an outer conduit or outer completion. In the embodiment of FIG. 10, the zonal isolation is completed by an inner completion inserted into the expandable completion. The inner completion comprises a production tubing 100 extending into the expandable completion. Packers 42 positioned between each of the zones to isolate the production of each zone and allow separate control and monitoring. It should be noted that the packers 42 may be replaced by seal bores and seal assemblies or other devices capable of creating zonal isolation between the zones (all of which are also referred to generally herein as a "seal"). In the embodiment shown, a valve 102 in the inner completion provides for control of fluid flow from the associated formation into the production tubing 100. The valve 102 may be controlled from the surface or a downhole controller by a control line 60.

Note that the control line 60 may comprise a fiber optic line that provides functionality and facilitates measurement of flow and monitoring of treatment and production. Although shown as extending between the inner and outer completions, the control line 60 may extend outside the outer completions or internal to the components of the completions equipment.

Figure 11:
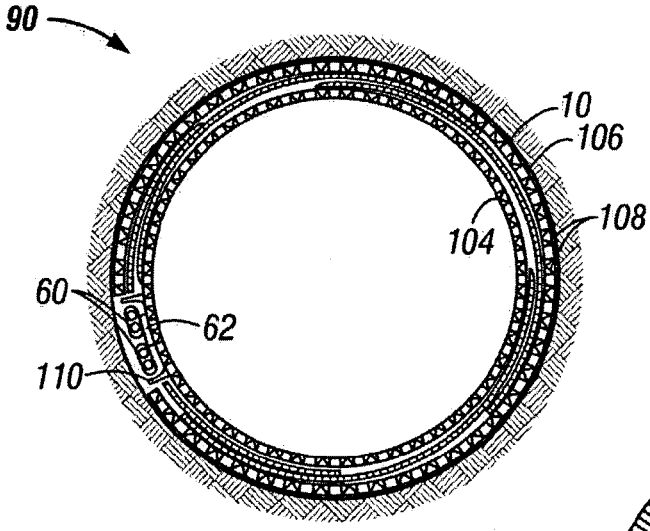
FIGS. 11 and 12 are cross sectional views of an expandable tubing showing numerous alternative designs.

As one example of an expandable screen 90, FIG. 11 illustrates a screen 28 that has an expandable base pipe 104, an expandable shroud 106, and a series of scaled filter sheets 108 therebetween providing the filter media 104. Some of the filter sheets are connected to a protective member 110 which is connected to the expandable base pipe 104. The figure shows, for illustration purposes, a number of control lines 60 and an intelligent completions device 62 attached to the screen 28.

Figure 12:
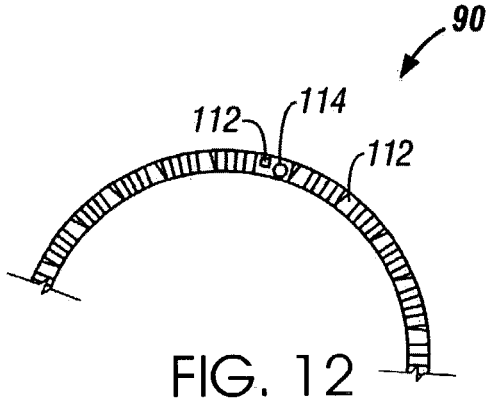

FIG. 12 illustrates another embodiment of the present invention in which an expandable tubing 90 has a relatively wider unexpanding portion (e.g., a relatively wider thick strut in a bistable cell). One or more grooves 112 extend the length of the expandable tubing 90. A control line 60 or intelligent completions device 62 may be placed in the groove 112 or other area of the expandable tubing. Additionally, the expandable tubing 90 may form a longitudinal passageway 114 therethrough that may comprise or in which a control line 60 or intelligent completions device 62 may be placed.

In addition to the primary screens 28 and expandable tubing 90, the control lines 60 also pass through connectors 120 for these components. For expandable tubing 90, the connector 120 may be formed similar to the tubing itself in that the control line may be routed in a manner as described above.

One difficulty in routing control lines through adjacent components involves achieving proper alignment of the portions of the control lines 60. For example, if the adjacent components are threaded it is difficult to ensure that the passageway through one components will align with the passageway in the adjacent component. One manner of accomplishing proper alignment is to use a timed thread on the components that will stop at a predetermined alignment and ensure alignment of the passageways. Another method of ensuring alignment is to form the passageways after the components have been connected. For example, the control line 60 may be clamped to the outside of the components. However, such an arrangement does not provide for the use of passageways or grooves formed in the components themselves and may require a greater time and cost for installation. Another embodiment that does allow for incorporation of passageways in the components uses some form of non-rotating connection.

Figure 13:
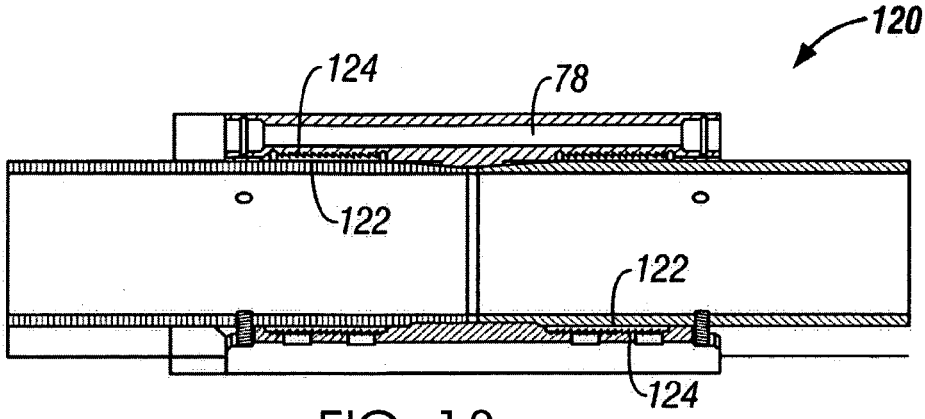
FIGS. 13 through 15 illustrate alternative embodiments of connectors.
Figure 14:
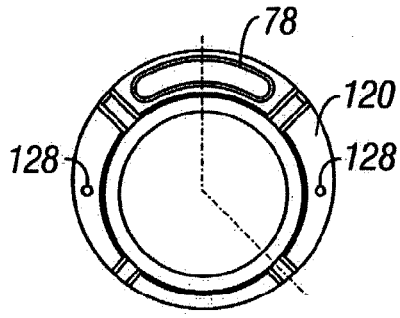

One type of non-rotating connector 120 is shown in FIGS. 13 and 14. The connector 120 has a set of internal ratchet teeth 122 that mate with external ratchet teeth 124 formed on the components to be connected. For example, adjacent screens 28 may be connected using the connector 120. Seals 126 between the connector 120 and components provide a sealed system. The connector 120 has passageways 128 extending therethrough that may be readily aligned with passageways in the connected equipment. Although shown as a separate connector 120, the ratchets may be formed on the ends of the components themselves to achieve the same resultant non-rotating connection.

Figure 15:
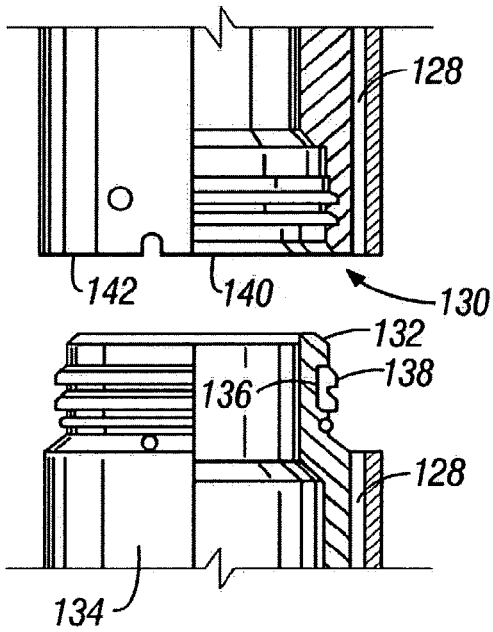

Another type of non-rotating connection is a snap fit connection 130. As best seen in FIG. 15, the pin end 132 of the first component 134 has a reduced diameter portion at its upper end, and an annular exterior groove 136 is formed in the reduced diameter portion above an O-ring sealing member externally carried thereon. A split locking ring member 138, having a ramped and grooved outer side surface profile as indicated, is captively retained in the groove 136 and lockingly snaps into a complementarily configured interior side surface groove 140 in the box end 142 of the second component 135 when the pin end 132 is axially inserted into the box end 142 with the passageway 128 of the pin end 132 in circumferential alignment that of the box end 142. Although shown as formed on the ends of the components themselves the snap fit connectors 130 may be employed in an intermediate connector 120 to achieve the same resultant non-rotating connection.

In one embodiment, a control line passageway is defined in the well. Using one of the routing techniques and equipment previously described. A fiber optic line is subsequently deployed through the passageway (e.g., as shown in U.S. Pat. No. 5,804,713). Thus, in an example in which the non-rotating couplings 120 are used, the fiber optic line is blown through the aligned passageways formed by the non-rotating connections. Timed threads may be used in the place of the non-rotating connector.

Figure 16:
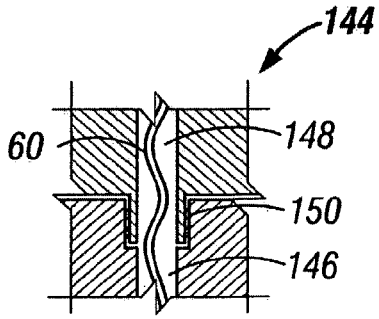
FIG. 16 illustrates an embodiment of a wet connect.

Often, a connection must be made downhole. For a conventional type control line 60, the connection may be made by stabbing an upper control line connector portion into a lower control line connector portion. However, in the case of a fiber optic line that is "blown" into the well through a passageway, such a connection is not possible. Thus, in one embodiment (shown in FIG. 16), a hydraulic wet connect 144 is made downhole to place a lower passageway 146 into fluid communication with an upper passageway 148. A seal 150 between the upper and lower components provides a sealed passageway system. The fiber optic line 60 is subsequently deployed into the completed passageway.

In one exemplary operation, a completion having a fiber optic control line 60 is placed in the well. The fiber optic line extends through the region to be gravel packed (e.g., through a portion of the screen 28 as shown in the figures). A service tool is run into the well and a gravel pack slurry is injected into the well using a standard gravel pack procedure as previously described. The temperature is monitored using the fiber optic line during the gravel pack operation to determine the placement of the gravel in the well. Note that in one embodiment, the gravel is maintained at a first temperature (e.g., ambient surface temperature) before injection into the well. The temperature in the well where the gravel is to be placed is at a second temperature that is higher than the first temperature. The gravel slurry is then injected into the well at a sufficient rate that it reaches the gravel pack area before its temperature rises to the second temperature. The temperature measurements provided by the fiber optic line are thus able to demonstrate the placement of the gravel in the well.

If it is determined that a proper pack has not been achieved, remedial action may be taken. In one embodiment, the gravel packed zone has an isolation sleeve, intelligent completions valve, or isolation valve therein that allows the zone to be isolated from production. Thus, if a proper gravel pack is not achieved, the remedial action may be to isolate the zone from production. Other remedial action may comprise injecting more material into the well.

In an alternative embodiment, sensors are used to measure the temperature. In yet another alternative embodiment, the fiber optic line or sensors are used to measure the pressure, flow rate, or sand detection. For example, if sand is detected during production, the operator may take remedial action (e.g., isolating or shutting in the zone producing the sand). In another embodiment, the sensors or fiber optic line measure the stress and/or strain on the completion equipment (e.g., the sand screen 28) as described above. The stress and strain measurements are then used to determine the compaction of the gravel pack. If the gravel pack is not sufficient, remedial action may be taken.

In another embodiment, a completion having a fiber optic line 60 (or one or more sensors) is placed in a well. A proppant is heated prior to injection into the well. While the proppant is injected into the well, the temperature is measured to determine the placement of the proppant. In an alternative embodiment the proppant has an initial temperature that is lower than the well temperature.

Similarly, the fiber optic line 60 or sensors 62 may be used to determine the placement of a fracturing treatment, chemical treatment, cement, or other well treatment by measuring the temperature or other well characteristic during the injection of the fluid into the well. The temperature may be measured during a strip rate test in like manner. In each case remedial action may be taken if the desired results are not achieved (e.g., injecting additional material into the well, performing an additional operation). It should be noted that in one embodiment, a surface pump communicates with a source of material to be placed in the well. The pump pumps the material from the source into the well. Further, the intelligent completions device (e.g., sensor, fiber optic line) in the well may be connected to a controller that receives the data from the intelligent completions device and provides an indication of the placement position using that data. In one example, the indication may be a display of the temperature at various positions in the well.

Figure 17A:
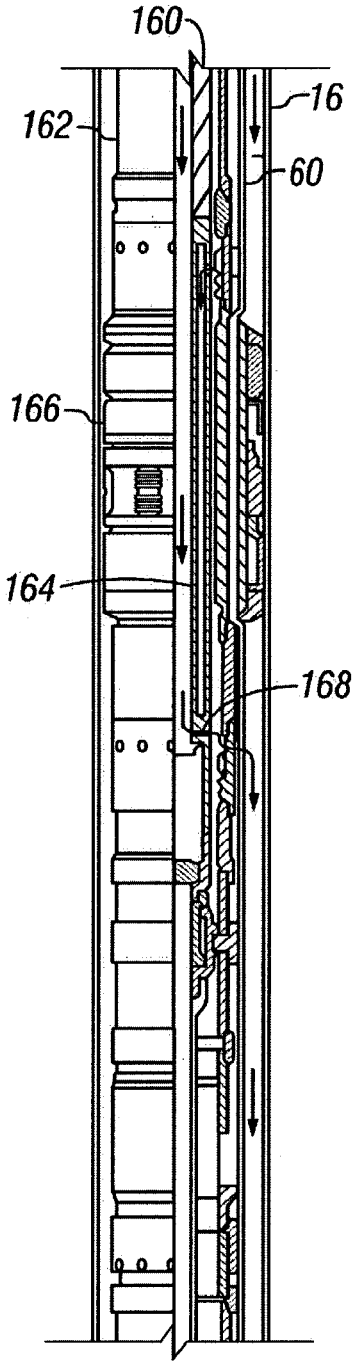
FIGS. 17A–C illustrate an example of a service tool according to an embodiment of the present invention.
Figure 17B:
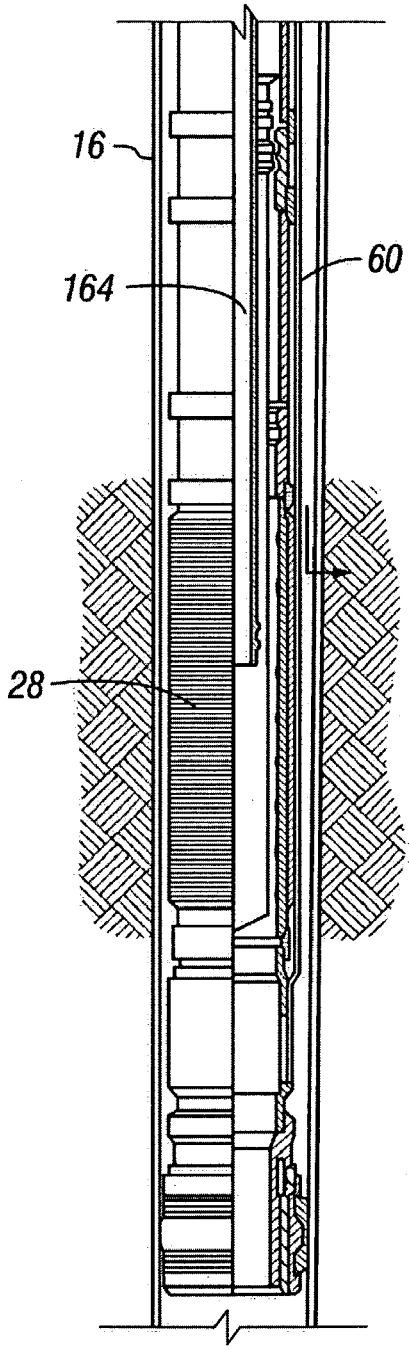

Referring now to FIGS. 17A and 17B, a service string 160 is shown disposed within the production tubing 162 and connected to a service tool 164. The service string 160 may be any type of string known to those of skill in the art, including but not limited to jointed tubing, coiled tubing, etc. Likewise, although shown as a thru-tubing service tool, the present invention may employ any type of service tool and service string. For example, the service tool 164 may be of the type that is manipulated by movement of the service tool 164 relative to the upper packer 166. A gravel pack operation is performed by manipulating the service tool 164 to provide for the various pumping positions/operations (e.g., circulating position, squeeze position, and reversing position) and pumping the gravel slurry.

Figure 17C:
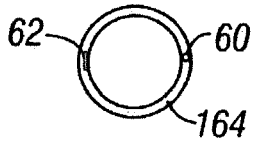

As shown in the figures, a control line 60 extends along the outside of the completion. Note that other control line routing may be used as previously described. In addition, a control line 60 or intelligent completions device 62 is positioned in the service tool 164. In one embodiment, the service tool 164 comprises a fiber optic line 60 extending along at least a portion of the length of the service tool 164. As with the routing of the control line 60 in a screen 28, the control line 60 may extend along a helical or other non-linear path along the service tool 164. FIG. 17C illustrates an exemplary cross section of the service tool 164 showing a control line 60 provided in a passageway of a wall thereof. The figure also shows an alternative embodiment in which the service tool 164 has a sensor 62 therein. Note that the control line 60 or sensor 62 may be placed in other positions within the service tool 164.

In one embodiment the fiber optic line in the service tool 164 is used to measure the temperature during the gravel packing operation. As an example, this measurement may be compared to a measurement of a fiber optic line 60 positioned in the completion to better determine the placement of the gravel pack. The fiber optic lines 60 may comprise or be replaced by one or more sensors 62. For example, the service tool 164 may have a temperature sensor at the outlet 168 that provides a temperature reading of the gravel slurry as it exits the service tool. Other types of service tools (e.g., a service tool for fracturing, delivering a proppant, delivering a chemical treatment, cement, etc.) may also employ a fiber optic line or sensor therein as described in connection with the gravel pack service tool 164.

In each of the monitoring embodiments above, a controller may be used to monitor the measurements and provide an interpretation or display of the results.

FIGS. 18A–D disclose yet another embodiment of the present invention comprising a service tool 164 that provides a fiber optic line therein. In the embodiment illustrated, the fiber optic line 60 is run along a washpipe 170 and to a position above a setting tool 172 to a special wet connect sub 174. This sub 174 allows for a "slick-line" conveyed (or otherwise conveyed) plug 176 to be set therein. The "slick-line" encapsulates a fiber optic line. This can use a control line or other line (e.g., tubing encapsulated line or line in a coiled tubing) or sensor, or it can be a wound wire or wireline with fiber optic encased therein.

Figure 18A:
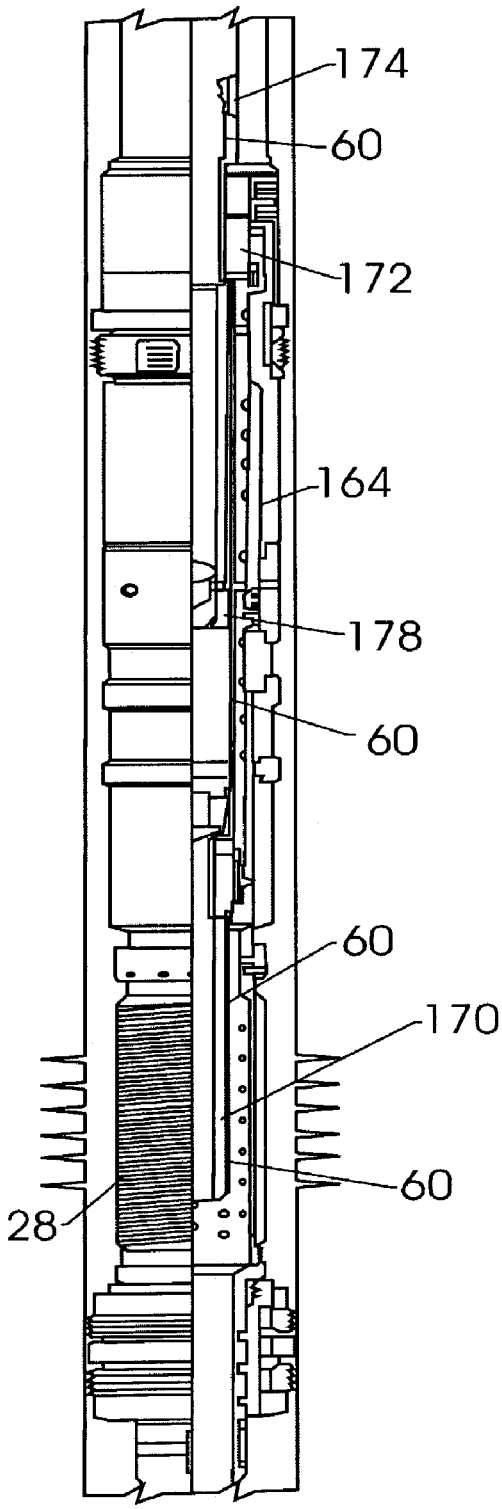
FIGS. 18A–D illustrate another embodiment of the service tool illustrated in FIG. 17.
Figure 18B:
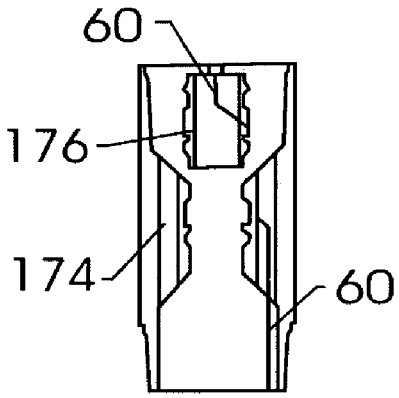
Figure 18C:
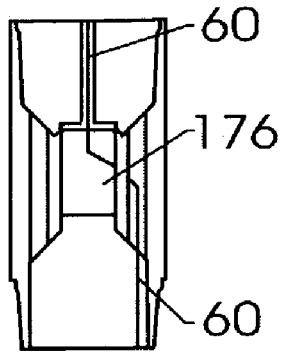
Figure 18D:
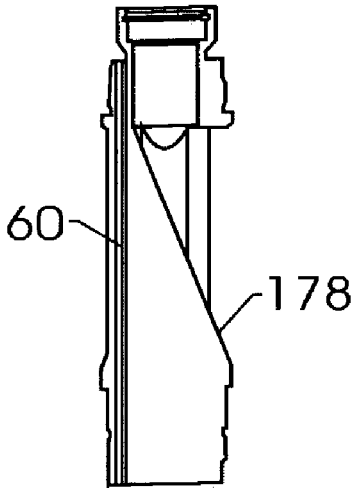

Once the plug 176 is in the wet connect sub 174, the operative connection between the fiber optic line 60 extending to the washpipe and the fiber optic line 60 extending to the surface is made, and real-time temperature data can be monitored through the fiber optic line 60. As shown in FIG. 18A, the washpipe 170 has a control line 60 mounted, either temporarily or permanently along the outside of the washpipe or mounted in some other manner that allows the fiber optic line in the control line to be exposed to the temperatures both internal of and external of the washpipe as desired. In this example, the washpipe is connected to the sand control service tool 164 with an integral fiber optic conduit. A fiber optic crossover tool (FOCT) 178 and the attached setting tool 172 have a fiber optic line routed therethrough. The wet connect sub is attached to the assembly above the setting tool 172.

In one embodiment, the wet connect sub 174 has an inside diameter that is sufficiently large that packer setting balls may pass through. It also has a profile in which the plug 176 may located (although he locating function may be spaced from the fiber optic wet connect function). In addition, at the time plug 176 is located, bypass area is allowed in this sub so as not to prevent the flow of fluids down the workstring, past the sub 174, and through the FOCT 178. The wet connect sub 174 also contains one half of a wet connection. The second half of the wet connection is incorporated in the plug 176.

The plug is transported in the well on a conveyance device such as a slickline, wireline, or tubing, that provides a fiber optic line. This fiber optic line is connected to the plug which has a fiber optic conduit connecting the fiber optic line to the second half of the wet connect. When the plug is landed in the sub 174 profile, a fiber optic connection is made and allows the measurement of the temperature (or other well parameters) with the entire fiber optic line, through the wet connect sub, through the FOCT and along the fiber optic placed in and/or along the washpipe. The temperature data, for example, is gathered and used in real time to monitor the flow of fluid during the gravel pack and to thereby allow real time adjustments to the gravel pack operation.

Figure 19A:
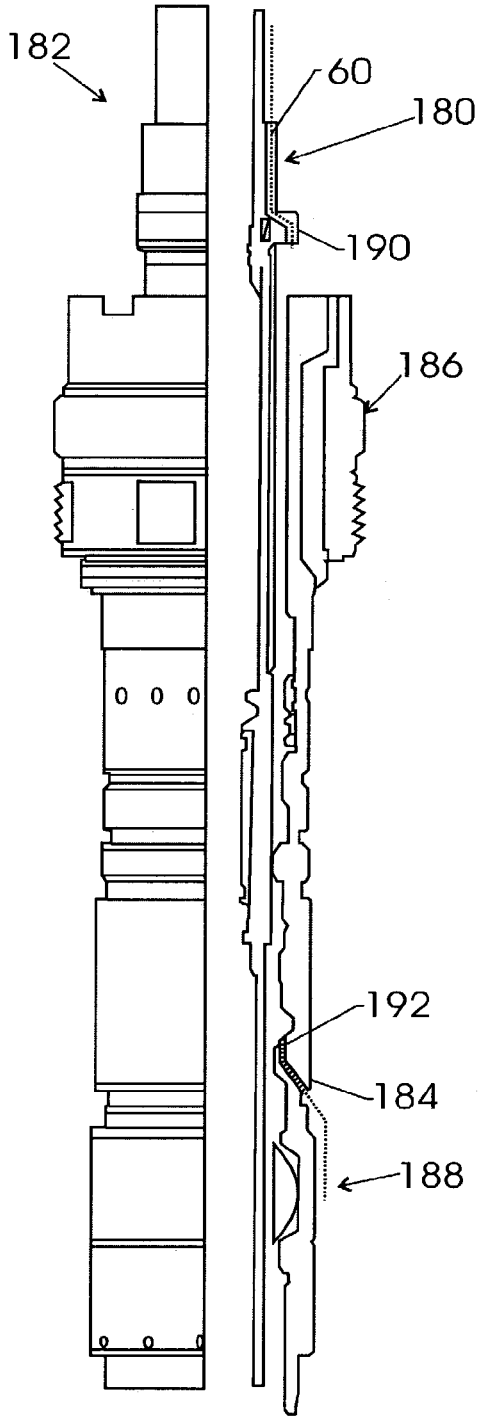
FIGS. 19A–C illustrate an embodiment of a control line system having a wet connect, according to an embodiment of the present invention.
Figure 19B:
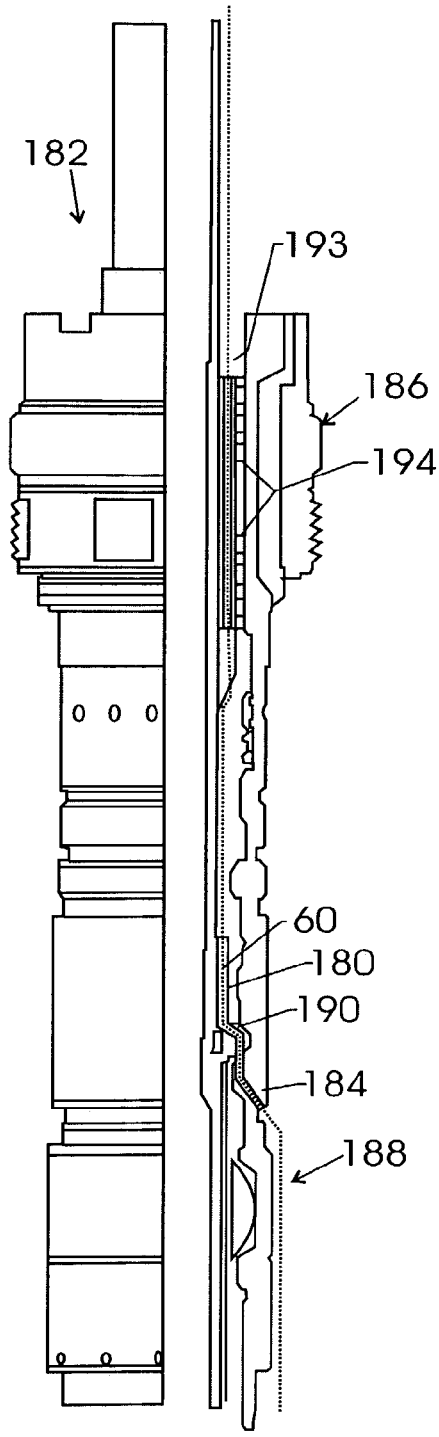

Referring generally to FIGS. 19A and 19B, another embodiment of a wet connect system is illustrated. The wet connect system facilitates the connection of a control line or control lines, e.g., control line 60. The system provides a wet connect tool 180 that may be run on a production string 182 for interfacing with a mating connect component 184 placed below a packer 186. The mating connect component 184 is, for example, part of a liner 188 that may have various control lines coupled to liner components below the packer 186.

After placing liner 188 in the wellbore, the wet connect tool 180 is run into the well, as illustrated in FIG. 19A. As the "run in" is continued, wet connect tool 180 is moved through packer 186 and into engagement with mating connect component 184. By way of example, wet connect tool 180 may comprise a spring loaded dog 190 that is biased into a corresponding receptacle 192 when the wet connect is completed, as illustrated in FIG. 19B. As production string 182 is landed, the fiber optic lines may be positioned using a passageway or passageways 193, e.g. gun drilled ports, through a seal assembly 194, as illustrated in FIG. 19B. Seal assembly 194 seals in the packer bore of packer 186. The fiber optic line or other control line 60 passes through passageway 193. As described above, multiple control lines can be used, and multiple passageways 193 may be formed longitudinally through seal assembly 194. The control line, e.g. control line 60, may comprise hydraulic control lines for actuation of components or delivery of wellbore chemicals, fiber optic lines, electrical control lines or other types of internal control lines depending on the particular application.

Figure 19C:
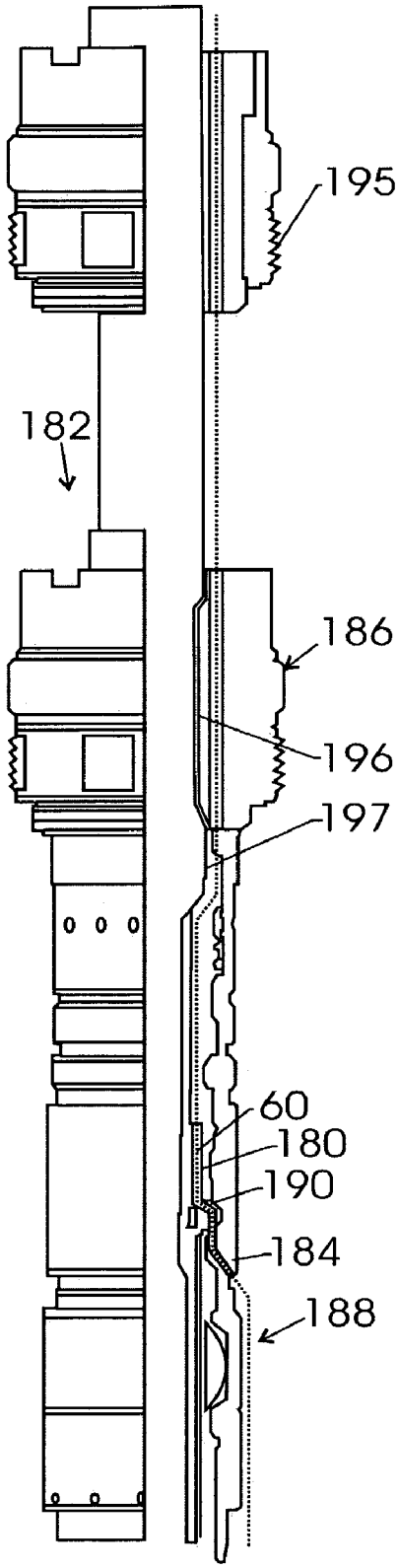

In an alternate embodiment, as illustrated in FIG. 19C, the gun drilled seal assembly is replaced with a multiport packer 195 used for sealing and anchoring. Multiport packer 195 is disposed above packer 186, which may be a gravel pack packer. In this system, a fluted locator 196 may be used within the packer bore without a seal. However, the fluted locator extends downwardly via, for example, a tube 197 for connection to other components.

In one exemplary application, a lower completion having a fiber optic instrumented sand screen, a packer, a service tool and a polished bore receptacle is run in hole. A fiber optic cable is terminated in the receptacle which contains one side of a fiber optic wet mateable connector. A dry-mate fiber optic connection may be utilized on an opposite end of the wet-mate connector.

Once the lower completion is in place, normal gravel packing operations can be performed beginning with setting of the packer and the service tool. Once the packer is tested, the service tool is released from the packer and shifted to another position to enable pumping of the gravel. Upon pumping of sufficient gravel, a screen out may be observed, and the service tool is shifted to another position to reverse out excess gravel. The service tool may then be pulled out of the wellbore. It should be noted that the service string carrying the service tool also can have a fiber optic line and/or plugable connector as well. This would allow use of the fiber optic line during the gravel pack or other service operation.

Subsequently, a dip tube is run in hole on the bottom of a production tubing with a fiber optic cable attached. The dip tube contains the other mating portion of the fiber optic wet-mate connection. It also may use a dry-mate connection on an opposite end to join with the fiber optic cable segment extending to the surface. The dip tube lands in the receptacle, and production seals are stabbed into a seal bore in the receptacle. The hardware containing the fiber wet-mate connector may be aligned by alignment systems as the connector portions are mated. During the last few inches of the mating stroke, a snap latch may be mated, and the fiber optic connection may be completed in a sealed, clean, oil environment. This is one example of an intelligent control line system that may be connected and implemented at a down hole location. Other embodiments of down hole control line systems are described below.

Figure 20:
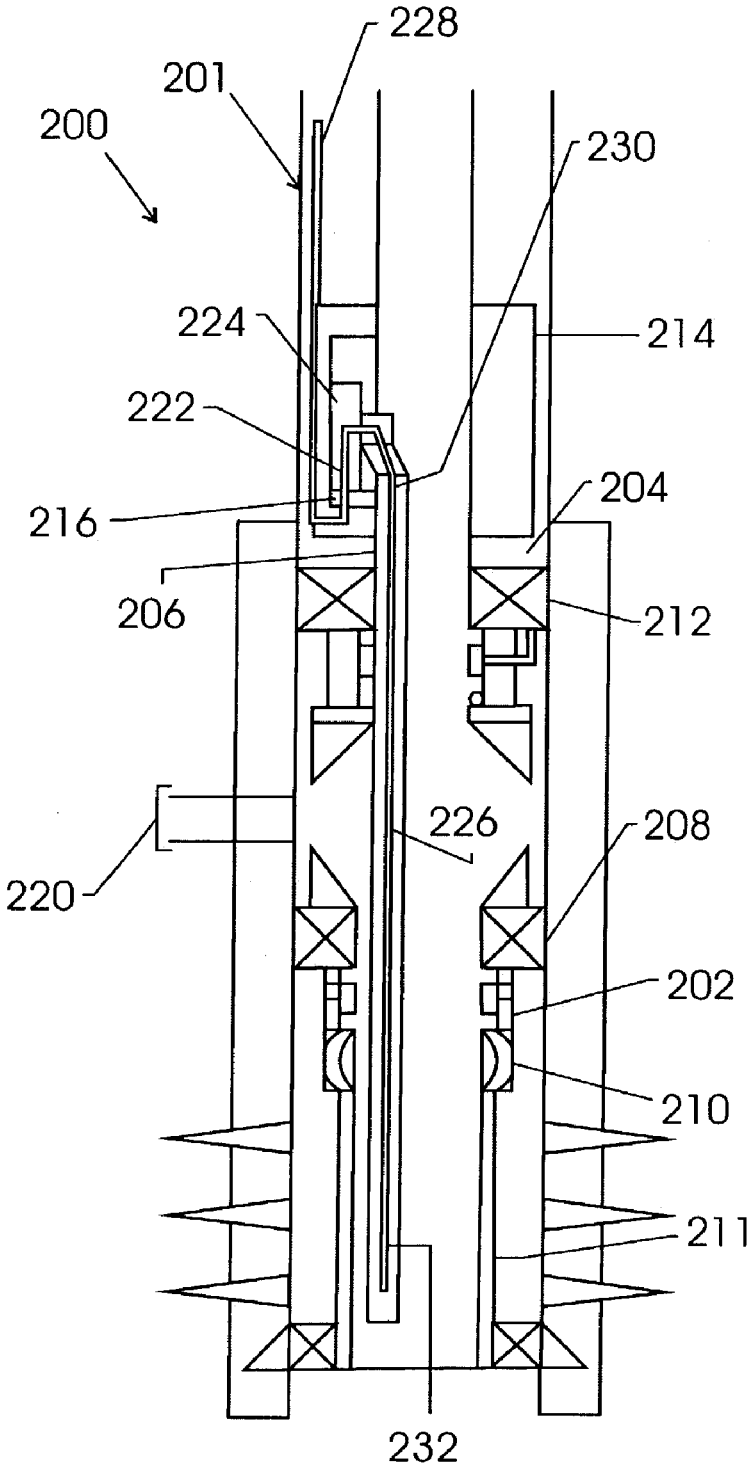
FIG. 20 is a schematic, cross-sectional view of an embodiment of a control line system according to one embodiment of the present invention.

Referring generally to FIG. 20, a well system 200 comprises a control line system 201 and is illustrated according to an embodiment of the present invention. System 200 is deployed within a wellbore and comprises a lower completion 202, an upper completion 204 and a stinger or a dip tube 206.

Lower completion 202 may comprise a variety of components. For example, the lower completion may comprise a packer 208, a formation isolation valve 210 and a screen 211, such as a base pipe screen. Formation isolation valve 210 may be selectively closed and opened by pressure pulses, electrical control signals or other types of control inputs. By way of example, valve 210 may be selectively closed to set packer 208 via pressurization of the system. In some applications, formation isolation valve 210 may be designed to close automatically after gravel packing. However, the valve 210 is subsequently opened to enable the insertion of dip tube 206.

In the embodiment illustrated, upper completion 204 includes a packer 212 and a side pocket sub 214, which may comprise a connection feature 216, such as a wet connect. Packer 212 and side pocket sub 214 may be mounted on tubing 218. Additionally, the lower completion 202 and upper completion 204 may be designed with a gap 220 therebetween such that there is no fixed point connection. By utilizing gap 220 between the lower and upper completions, a "space out" trip into the well to measure tubing 218 is not necessary. As a result, the time and cost of the operation is substantially reduced by eliminating the extra out trip down hole.

Upon placement of lower completion 202 and upper completion 204, dip tube 206 is run through tubing 218 on, for example, coiled tubing or a wireline. Dip tube 206 comprises a corresponding connection feature 222, such as a wet connect mandrel 224 that engages connection feature 216.

In the embodiment illustrated, engagement of connection feature 216 and corresponding connection feature 222 forms a wet connect by which a lower control line 226, disposed in dip tube 206, is coupled with an upper control line 228, disposed on upper completion 204, to form an overall control line 230. Control line 230 may be a single control line or multiple control lines. Additionally, control line 230 may comprise tubing for conducting hydraulic control signals or chemicals, an electrical control line, fiber optic control line or other types of control lines. The overall control line system 201 is particularly amenable to use with control lines such as fiber optic control lines that may incorporate or be combined with sensors such as distributed temperature sensors 232. In some embodiments, connection feature 216 and corresponding connection feature 222 of system 200 comprise a hydraulic wet connect. With a hydraulic wet connect, system 200 may further comprise a fiber optic or other signal carrier that is subsequently inserted through the tubing by, for example, blowing the signal conductor through the tubing.

Figure 21:
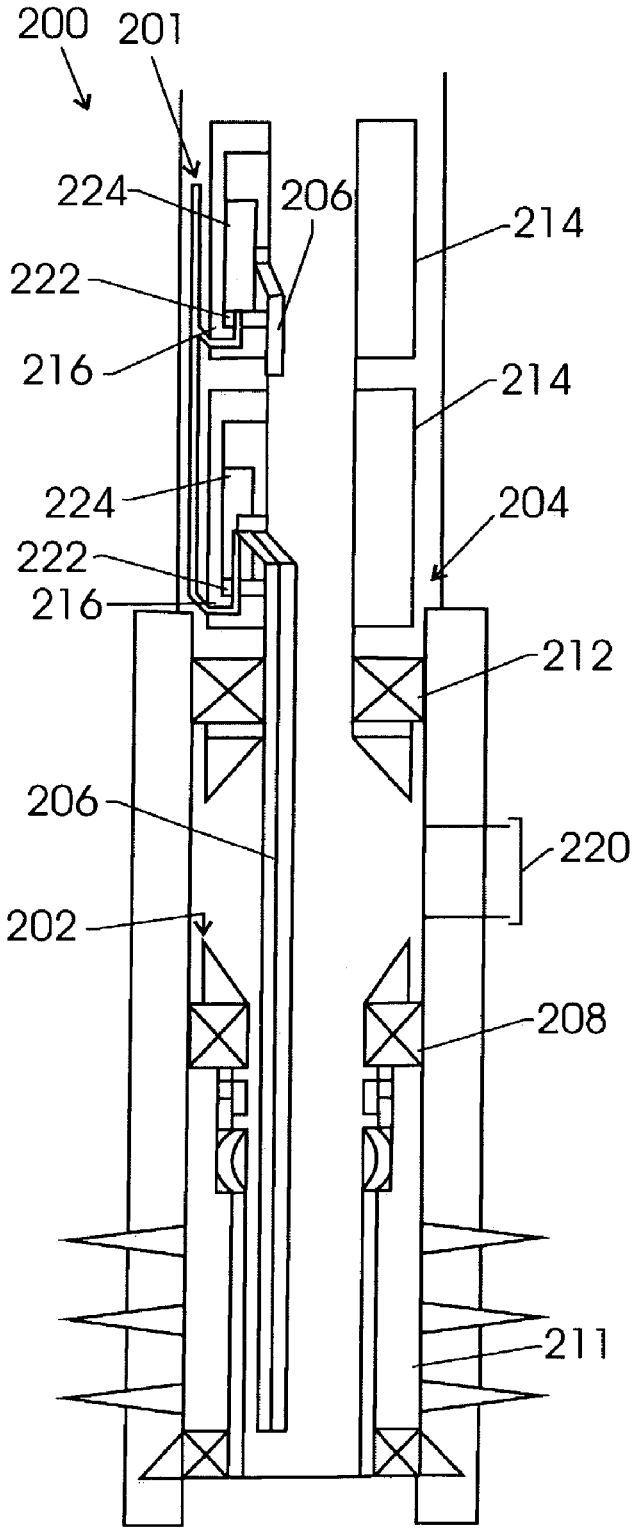
FIG. 21 illustrates an alternate embodiment of the control line system illustrated in FIG. 20.

In another embodiment illustrated in FIG. 21, the upper completion 204 comprises a plurality of side pocket subs 214 arranged in a stacked configuration. At least one dip tube 206 is connected to connection feature 216 via a corresponding connection feature, e.g. a wet connect mandrel 224. The connection features 216 may be located at different angular positions to accommodate insertion of dip tubes 206 through upper packer 212 and lower packer 208.

Figure 22:
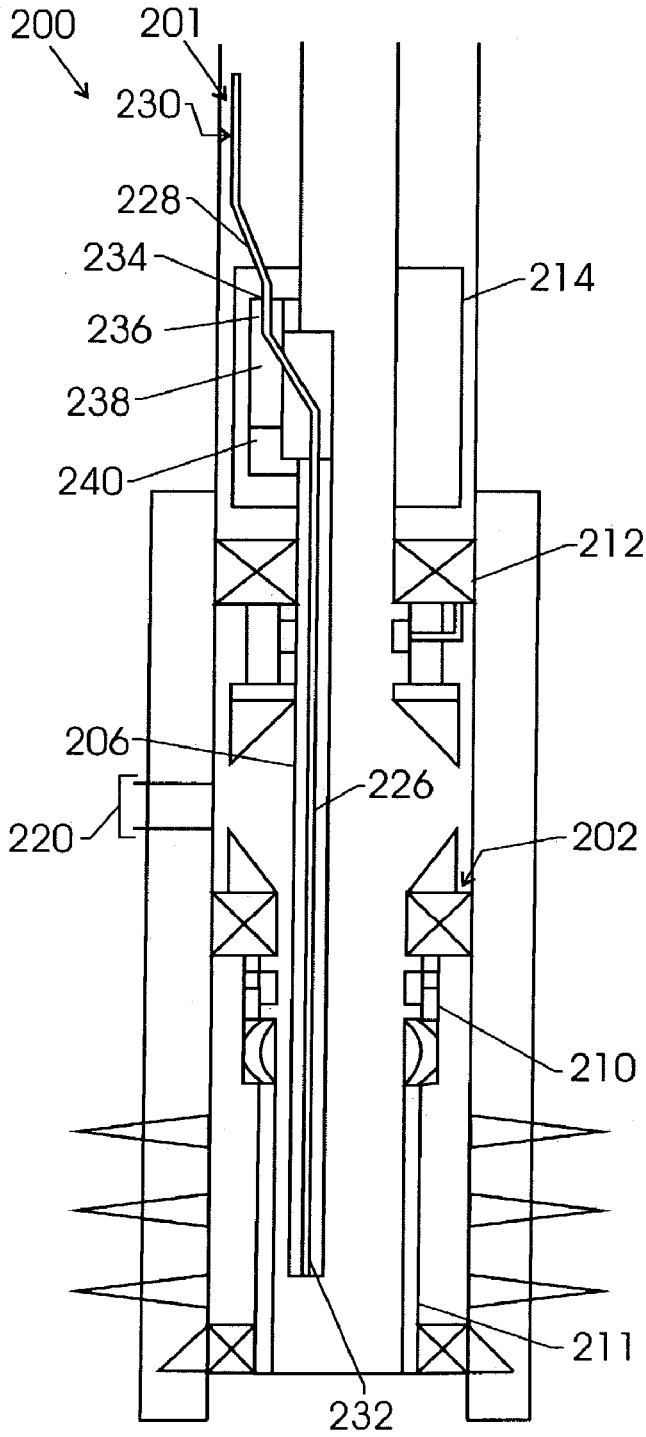
FIG. 22 illustrates another alternate embodiment of the control line system illustrated in FIG. 20.

Another embodiment of system 200 is illustrated in FIG. 22. In this embodiment, side pocket sub 214 comprises an upper connection feature 234 to which dip tube 206 is coupled in a "lock-up" position rather than a "lock-down" position, as in the embodiments illustrated in FIGS. 20 and 21. In other words, a connection, such as a wet connect, is formed by moving a corresponding connecting feature 236 of dip tube 206 upwardly into engagement with upper connection feature 234 of side pocket sub 214. As described with previous embodiments, the connection may be a wet connect in which corresponding connection feature 236 is formed on a wet connect mandrel 238 sized to fit within the side pocket 240 of side pocket sub 214. As previously discussed, control line 230 may comprise a variety of control lines, but one example is a fiber optic control line that forms a fiber optic wet connect across upper connection 234 and corresponding connection feature 236.

Figure 23:
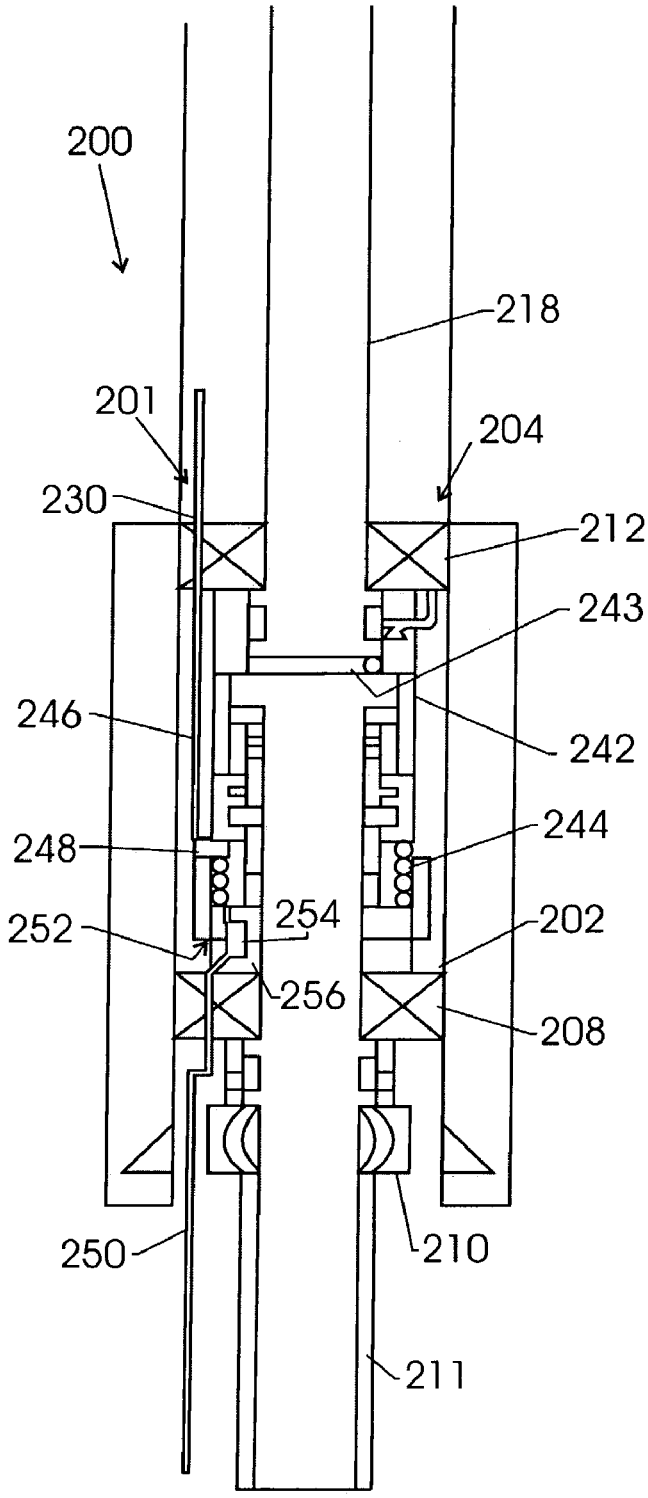
FIG. 23 illustrates another embodiment of the control line system illustrated in FIG. 20.

Referring generally to FIG. 23, another embodiment of system 200 is illustrated. In this embodiment, the lower completion 202 having, for example, packer 208, formation isolation valve 210 and screen 211 is coupled to upper completion 204 by an expansion joint 242. In the example illustrated, expansion joint 242 comprises a telescopic joint that compensates for deviation in the gap or distance between lower completion 202 and upper completion 204. Also, upper completion 204 may have a tubing isolation valve 243 to, for example, facilitate setting of packer 212.

In this embodiment, the control line 230 comprises a coiled section 244 to reduce or eliminate stress on control line 230 during expansion or contraction of joint 242. Control line 230 may comprise a variety of control lines, including hydraulic lines, chemical injection lines, electrical lines, fiber optic control lines, etc. In the example illustrated, control line 230 comprises a fiber optic control line having an upper section 246 coupled to coiled section 244 by a fiber optic splice 248. Coiled section 244 is connected to a lower control line section 250 by a connector 252, such as a fiber optic wet connect 254 and latch 256. Thus, the overall control line 230 is formed when upper completion 204, including expansion joint 242 and coiled section 244, is coupled to lower completion 202. As illustrated, lower control line section 250 may be deployed externally to screen 211 and may deploy a variety of sensors, e.g., a distributed temperature sensor.

Figure 24:
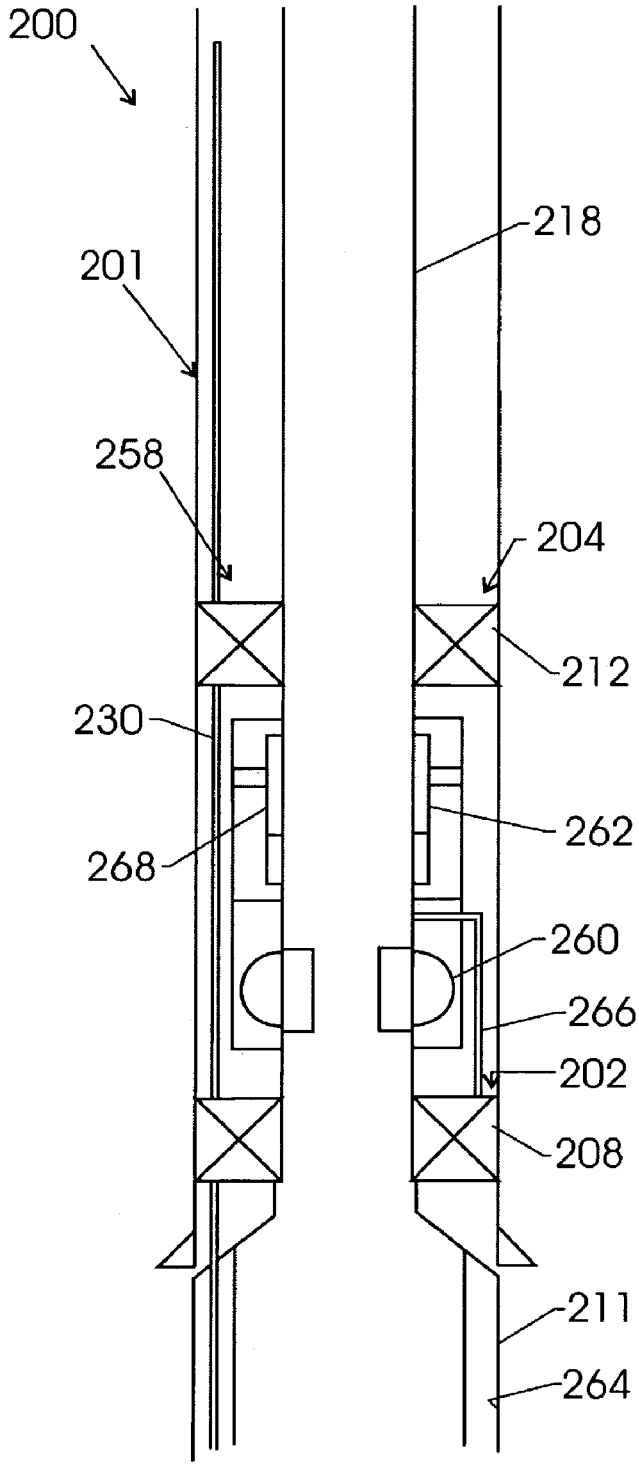
FIG. 24 illustrates another embodiment of the control line system illustrated in FIG. 20.

Another embodiment of system 200 is illustrated in FIG. 24. In this embodiment, an entire completion 258 comprising lower completion 202 and upper completion 204 can be run in hole in a single trip. Accordingly, it is not necessary to form wet connects along control line 230. Although completion 238 may comprise a variety of embodiments, in the embodiment illustrated, packer 212 and packer 208 are mounted on tubing 218. Between packer 208 and 212, a valve 260, such as a ball valve, is mounted. Additionally, a circulating valve 262 may be mounted above valve 260. Below packer 208, screen 211 comprises an expandable screen section 264 along which or through which control line 230 extends.

In operation, the entire completion 258 along with control line 230 is run into the wellbore in a single trip. The system is landed out on a tubing hanger "not shown", and a control signal, such as a pressure pulse, is sent to close ball valve 260. Subsequently, the interior of tubing 218 is pressurized sufficiently to set the screen hanger packer, packer 208, via a separate control line 266. Next, a screen expander tool is run through tubing 218 on a work string. Valve 260 is then opened by, for example, a pressure pulse or other command signal or by running a shifting tool at the end of the screen expander tool. The screen expander is then moved through screen 211 to transition the screen to its expanded state, illustrated in FIG. 24 as expanded screen 264.

Upon expansion of the screen, the expanding tool is pulled out of the wellbore, and the valve 260 is closed with, for example, a shifting tool at the end of the screen expander. Once the expander tool is removed from the wellbore, a pressure pulse or other appropriate command signal is sent down hole to open circulating valve 262 via, for example, a sliding sleeve 268. The fluid in tubing 218 is then displaced with a completion fluid, such as a lighter fluid or a thermal insulation fluid. Subsequently, the valve is closed to permit pressure buildup within tubing 218. The pressure is increased sufficiently to set upper packer 212. Then, a pressure pulse or other appropriate command signal is sent down hole to open valve 260. At this stage, the entire completion 258 is set at a desired location within the wellbore along with control line 230. Furthermore, the entire procedure only involved a single trip down hole.

Figure 25:
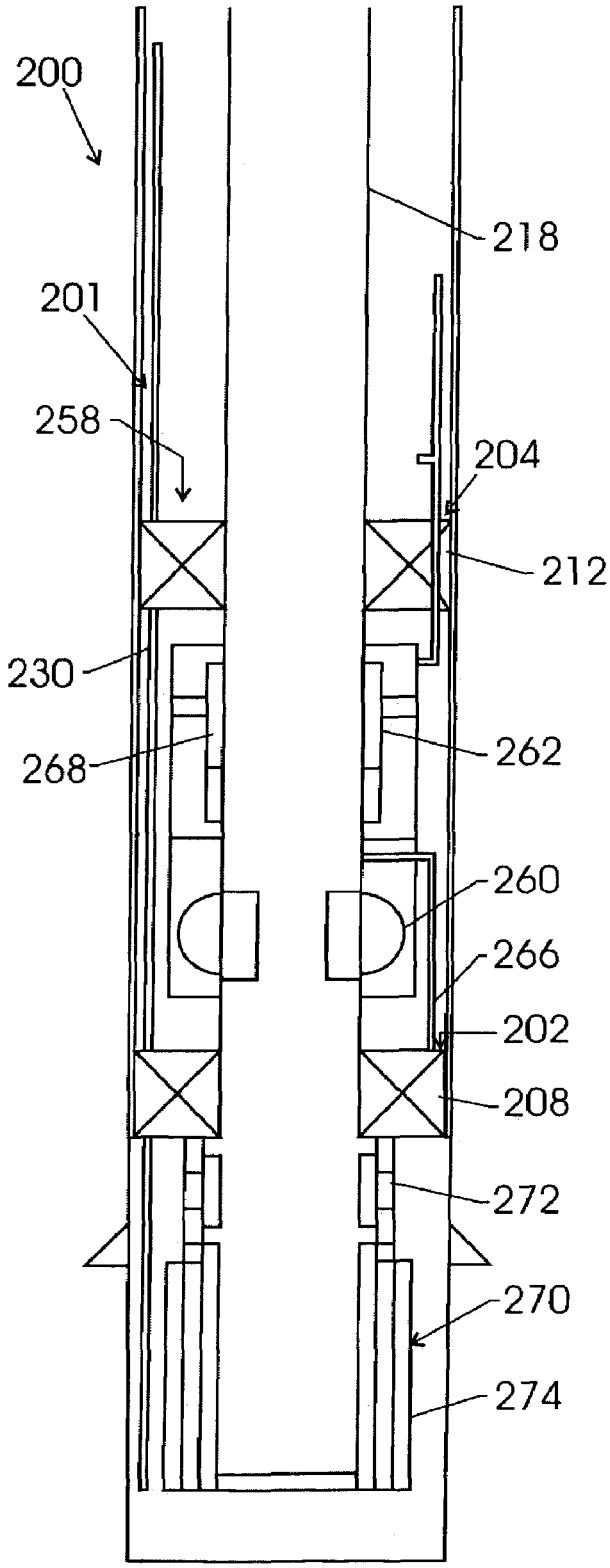
FIG. 25 is a view similar to FIG. 24 with a gravel pack system.

An embodiment similar to that of FIG. 24 is illustrated in FIG. 25. In this embodiment, the expandable sand screen is replaced with a gravel pack system 270. By way of example, gravel pack system 270 may comprise a gravel pack port closure sleeve 272 and a base pipe sand screen 274. The control line 230 may be deployed externally of the base pipe sand screen 274. In operation, the same single trip procedure as discussed with respect to FIG. 24 may be utilized. However, instead of performing the act of expanding the sand screen, a gravel pack is run. It also should be noted that. the systems illustrated generally in FIGS. 24 and 25 can be utilized with multi-zoned intelligent completions.

Figure 26:
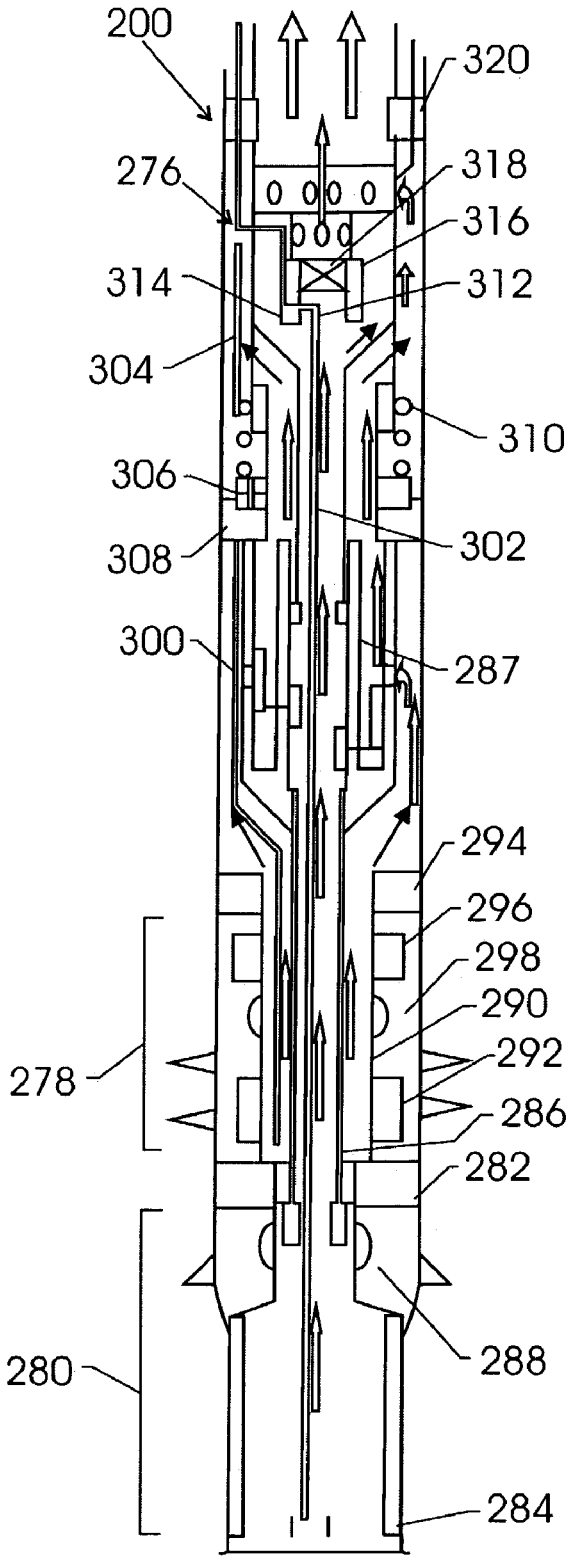
FIG. 26 is an embodiment of a control line system, for use in a plurality of use in wellbore zones.

Another embodiment of system 200 is illustrated in FIG. 26. In this embodiment, a multiple completion 276 is illustrated for use in at least two wellbore zones 278, 280. Wellbore zone 280 is isolated by a packer 282 to which an expandable sand screen 284 is connected. A tubing 286 extends through packer 282 and into communication with expandable sand screen 284. Tubing 286 may utilize a polished bore receptable 287 above packer 282 to facilitate construction of multiple completion 276. Additionally, a formation isolation valve 288 may be deployed between packer 282 and sand screen 284.

Above packer 282, a larger tubing 290 encircles tubing 286 and is coupled to a screen, such as a base pipe screen 292. Screen 292 allows fluid from wellbore zone 278 to enter the annulus between tubing 286 and larger tubing 290. Larger tubing 290 extends to a packer 294 deployed generally at an upper region of wellbore zone 278 to isolate wellbore zone 278. Additionally, a port closure sleeve 296 and a flow isolation valve 298 may be deployed between screen 292 and packer 294.

A dip tube 300 incorporating a control line extends into wellbore zone 278 intermediate tubing 286 and larger tubing 290. An additional dip tube 302 having, for example, a fiber optic control line, is deployed through tubing 286 into the lower wellbore zone 280. Each of the dip tubes 300 and 302 may be deployed according to methods described above with respect to FIGS. 20–23. For example, a control line 304 associated with dip tube 300 may be connected though a wet connect/snap latch mechanism 306 disposed above a packer 308 located up hole from packer 294. As described with reference to FIG. 23, an expansion joint 310 may be utilized to facilitate the connection of wet connect and snap latch 306 when an upper completion is moved into location within the wellbore above packer 308. Furthermore, dip tube 302 and its associated control line 312 may be moved through the center of tubing 286 and into connection with the upper portion of control line 312 via a wet connect 314 disposed in a side pocket sub 316. It should be noted that in at least some applications, a plug 318 may be utilized in cooperation with side pocket sub 316 to selectively block flow through tubing 286 while the tubing is pressurized to set upper packer 320 disposed above side pocket sub 316. Accordingly, by sequentially moving completion sections to appropriate wellbore locations, a multiple completion can be constructed with separate control lines isolated in separate wellbore zones. Also, individual dip tubes in combination with, for example, a fiber optic line may be used to sense parameters from more than one zone. Center dip tube 302 and an inner fiber optic line can be used to measure temperature in zones 278 and 280 without direct contact with fluid from both zones.

Figure 27:
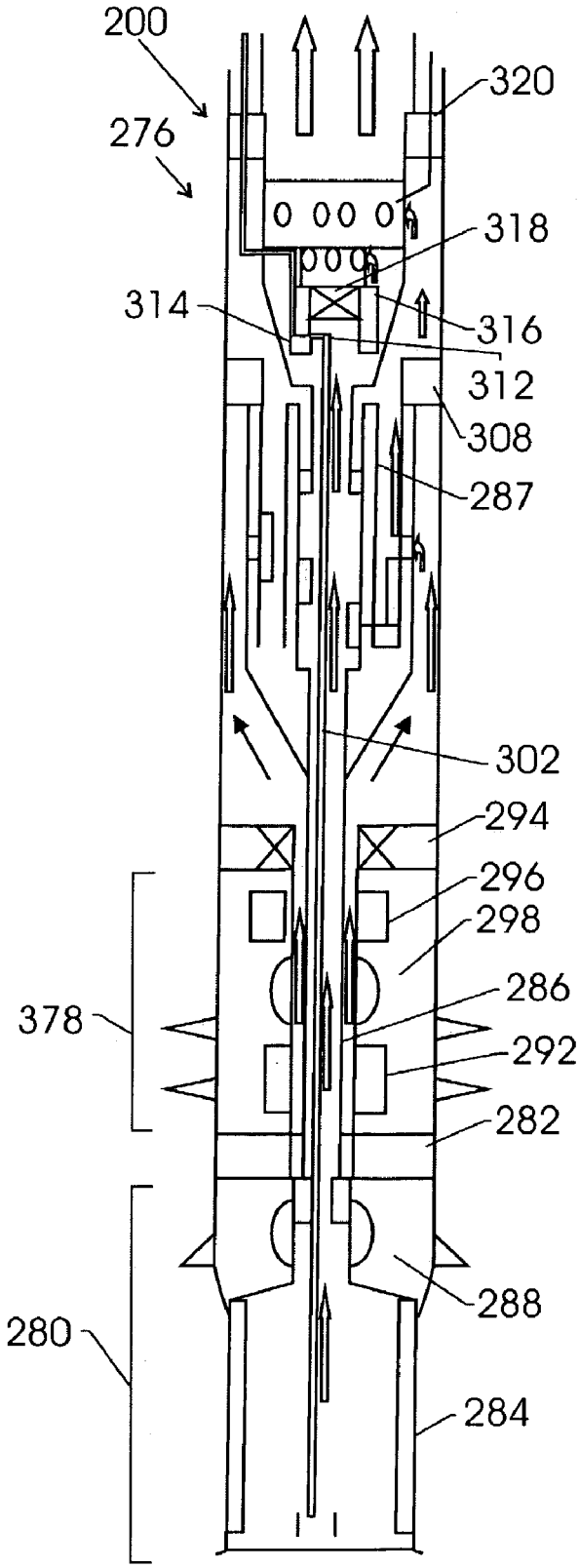
FIG. 27 is a view similar to FIG. 6 with a single dip tube.

In FIG. 27, for example, another embodiment of multiple completion 276 is illustrated. In this embodiment, fluid is produced from multiple wellbore zones, e.g. wellbore zone 278 and wellbore zone 280, but the outlying dip tube 300 has been eliminated. Accordingly, expansion joint 310 also is no longer necessary in this particular application. As illustrated, the single dip tube 302 extends through tubing 286 into the interior of expandable sand screen 284. As with previous embodiments, the dip tube 302 can be utilized for a variety of applications, including chemical injection, sensing and other control line related functions. For example, dip tube 302 may be perforated to expose an internal fiber optic distributed temperature sensor.

Figure 28:
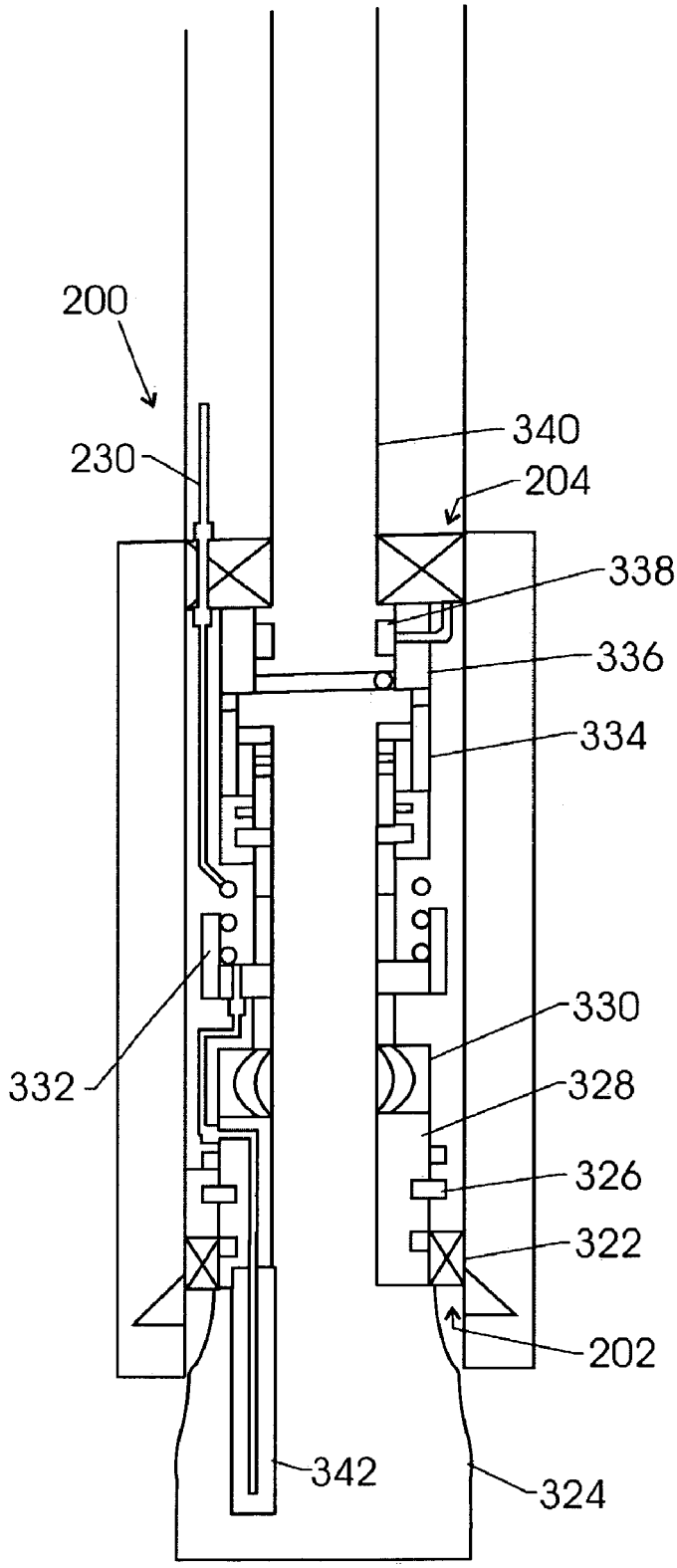
FIG. 28 is another embodiment of the control line system illustrated in FIG. 20.

Another embodiment of a system 200 is illustrated in FIG. 28. In this embodiment, the control line 230 is combined with an embodiment of upper completion 204 that may be deployed in a single trip. By way of example, lower completion 202 comprises a packer 322, such as a screen hangar packer, and sand screen 324, such as an expandable sand screen, suspended from packer 322. Additionally, a latch member 326 may be deployed above packer 322 to receive upper completion 204.

Initially, packer 322 and expandable sand screen 324 are positioned in the wellbore, and sand screen 324 is expanded. Subsequently, upper completion 204 along with one or more control lines 230 is run in hole and latched to latch member 326. In this embodiment, upper completion 204 may comprise a snap latch assembly 328 for coupling to latch member 326. Additionally, upper completion 204 comprises a formation isolation valve 330, a control line coiled section 332, a space out contraction/expansion joint 334, a tubing isolation valve 336 and an upper packer 338 all mounted to tubing 340.

The control line or lines 230 extend through upper packer 338 to coil section, 332 where the control lines are coiled to accommodate lineal contraction or expansion of joint 334. From coil section 332, the control line or lines 230 extend around formation isolation valve 330 and through snap latch assembly 328 to a dip tube 342 extending into sand screen 324.

With this design, the formation isolation valve 330 may be in a closed position subsequent to latching upper completion 204 to lower completion 202. This allows for deployment of control lines 230 and dip tube 342 prior to, for example, changing fluid in tubing 340, a procedure that requires closure of formation isolation valve 330. The upper tubing isolation valve 336 enables the selective setting of upper packer 338 prior to opening tubing 340. Thus, the entire upper completion and control line 230 along with dip tube 342 can be deployed in a single trip without the formation of any control line wet connects.

Figure 29:
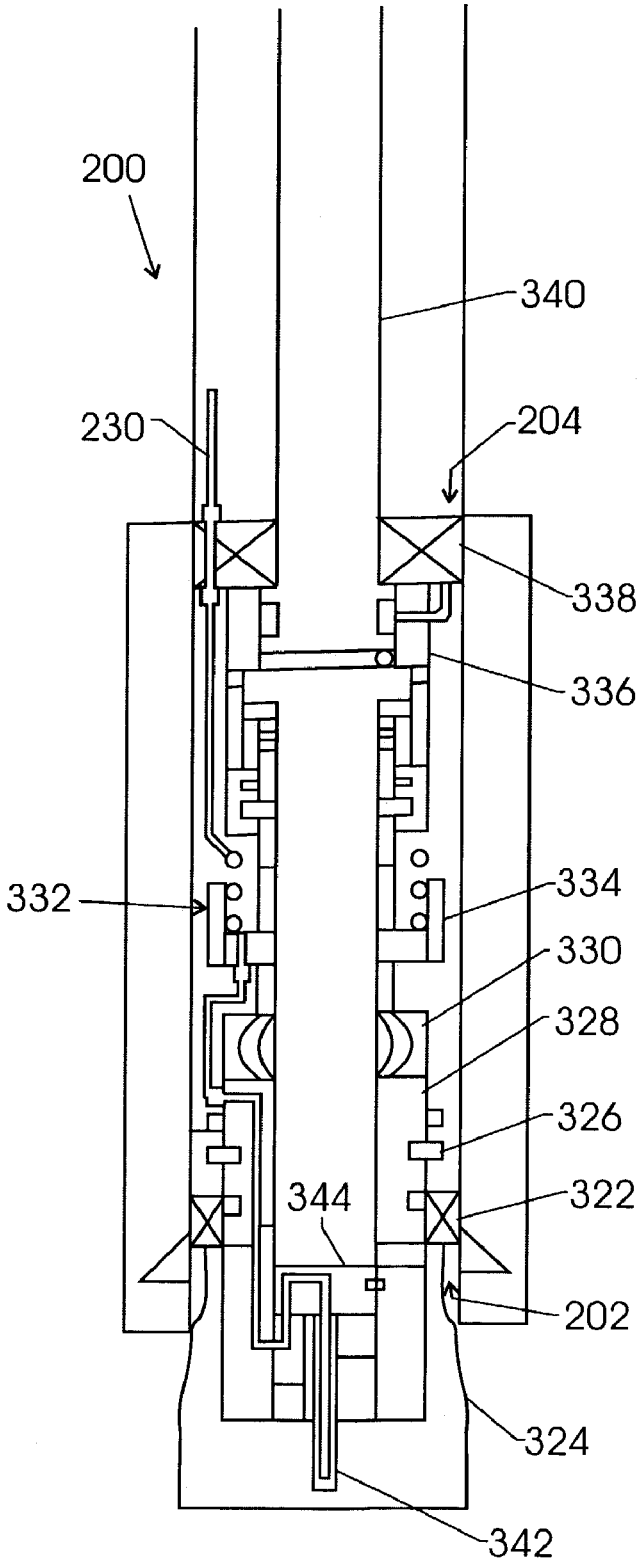
FIG. 29 is a view similar to FIG. 28 with an embodiment of a dip tube mounted on a removable plug.

In FIG. 29, a similar design to that of FIG. 28 is illustrated but with a removable stinger/dip tube 342. In this embodiment, the dip tube 342 is coupled to a retrievable plug 344. The control line or lines 230 are routed through plug 344 and into or along dip tube 342. However, the retrievable plug allows the dip tube 342 to be retrieved through tubing 340 without pulling upper completion 204. In the embodiment illustrated, there is no wet connect between retrievable plug 344 and the remainder of upper completion 204. Accordingly, if plug 344 and dip tube 342 are retrieved, the control line 230 is cut or otherwise severed.

Figure 30:
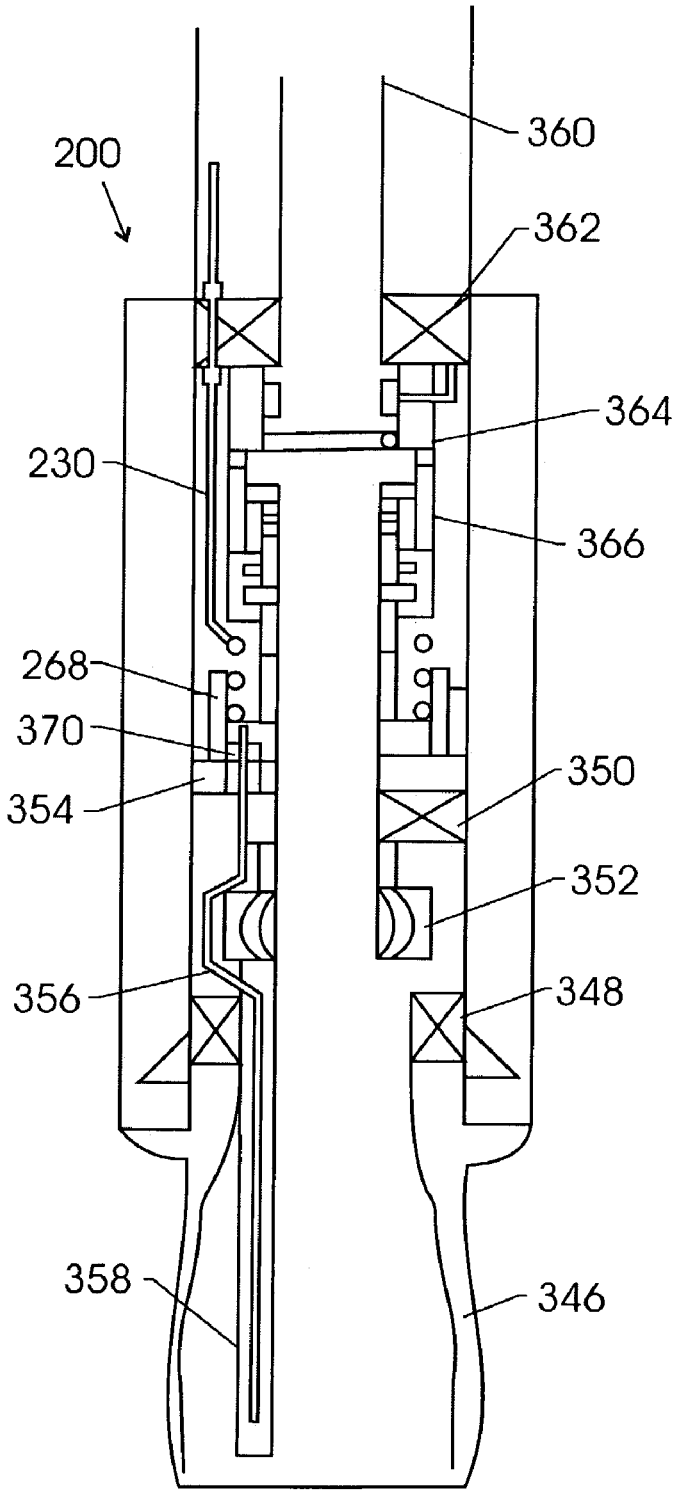
FIG. 30 is another embodiment of the control line system illustrated in FIG. 20.

Referring generally to FIG. 30, another configuration of control line system 200 is illustrated. In this embodiment, a sand screen such as an expandable sand screen 346, along with a screen hangar packer 348 are initially run into the wellbore. Subsequently, an anchor packer 350 along with a formation isolation valve 352, a wet connect member 354 and a lower section 356 of control line 230 are run in hole and positioned within the wellbore. In this embodiment, a dip tube 358 is provided to receive at least a portion of control line lower section 356, and dip tube 358 is positioned to extend through screen hangar packer 348 into expandable sand screen 346.

Upon placement of anchor packer 350, the upper section of the completion may be run in hole. The upper completion is connected to a tubing 360 and comprises a packer 362. A tubing isolation valve 364 is position below packer 362, and a space out contraction/expansion joint 366 is located below valve 364. Control line 230 is coupled to a control line coil section 368 and terminates at a corresponding wet connect member 370. The corresponding wet connect member 370 is designed and positioned to pluggably engage connector member 354 to form a wet connect.

Figure 31:
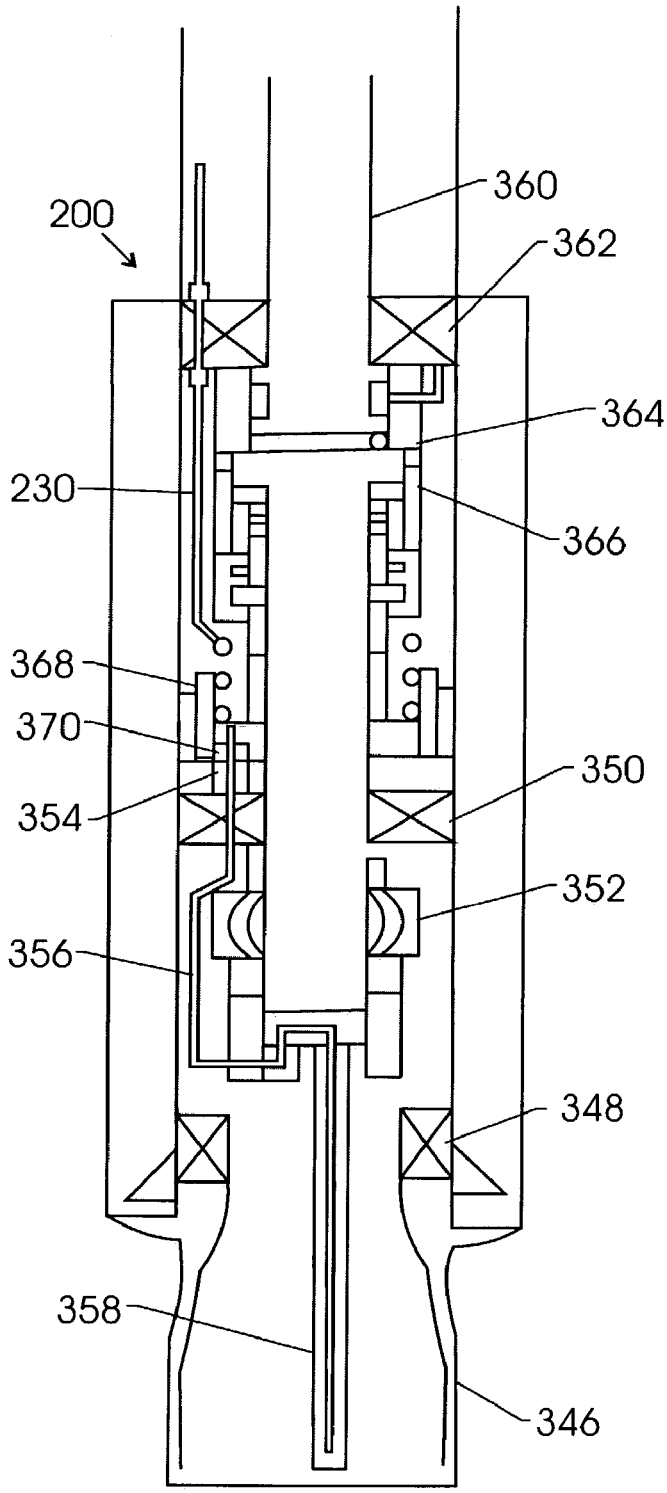
FIG. 31 is a view similar to FIG. 30 in which an embodiment of a dip tube is mounted on a removable plug.

A similar embodiment is illustrated in FIG. 31. However, in this embodiment, dip tube 358 is coupled to a removable plug 372. As described above with reference to FIG. 29, removable plug 372 enables the removal of dip tube 358 through tubing 360 without removal of the completion or segments of the completion.

Figure 32:
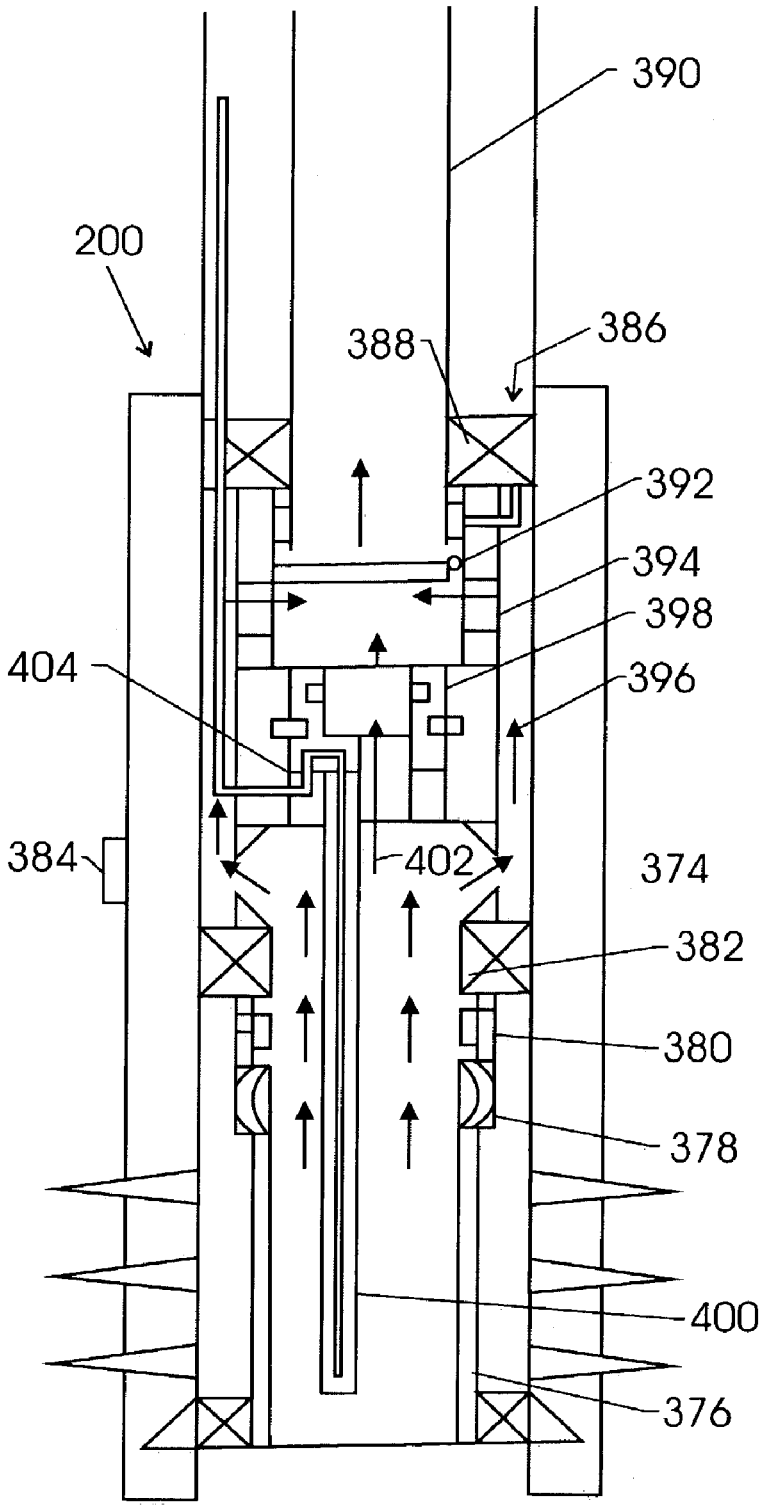
FIG. 32 illustrates another embodiment of the control line system illustrated in FIG. 20.

Referring generally to FIG. 32, another embodiment of system 200 is illustrated. In this embodiment, one example of a lower completion 374 comprises a screen 376, such as a base pipe screen, a formation isolation valve 378, a port closure sleeve 380 and a packer 382. However, a variety of other components can be added or interchanged in the construction of lower completion 374. A space out gap is disposed between lower completion 374 and an upper completion 386. By way of example, upper completion 386 comprises an upper packer 388 mounted to tubing 390. A tubing isolation valve 392 is disposed below packer 388 in cooperation with tubing 390. A slotted pup 394 is disposed below tubing isolation valve 392 to permit inwardly directed fluid flow from an outer fluid flow path 396. The outer fluid flow path 396 flows around a control line side step plug 398 to which a dip tube 400 is mounted at an offset location to permit a generally centralized fluid flow along a fluid flow path 402. Thus, fluid may flow to tubing 390 via outer or inner flow paths. The side step plug 398 may be designed to receive fiber optic lines or other types of control lines therethrough. The control line can be connected through a wet connect 404 proximate side step plug 398, or a dry connect may be utilized.

Figure 33:
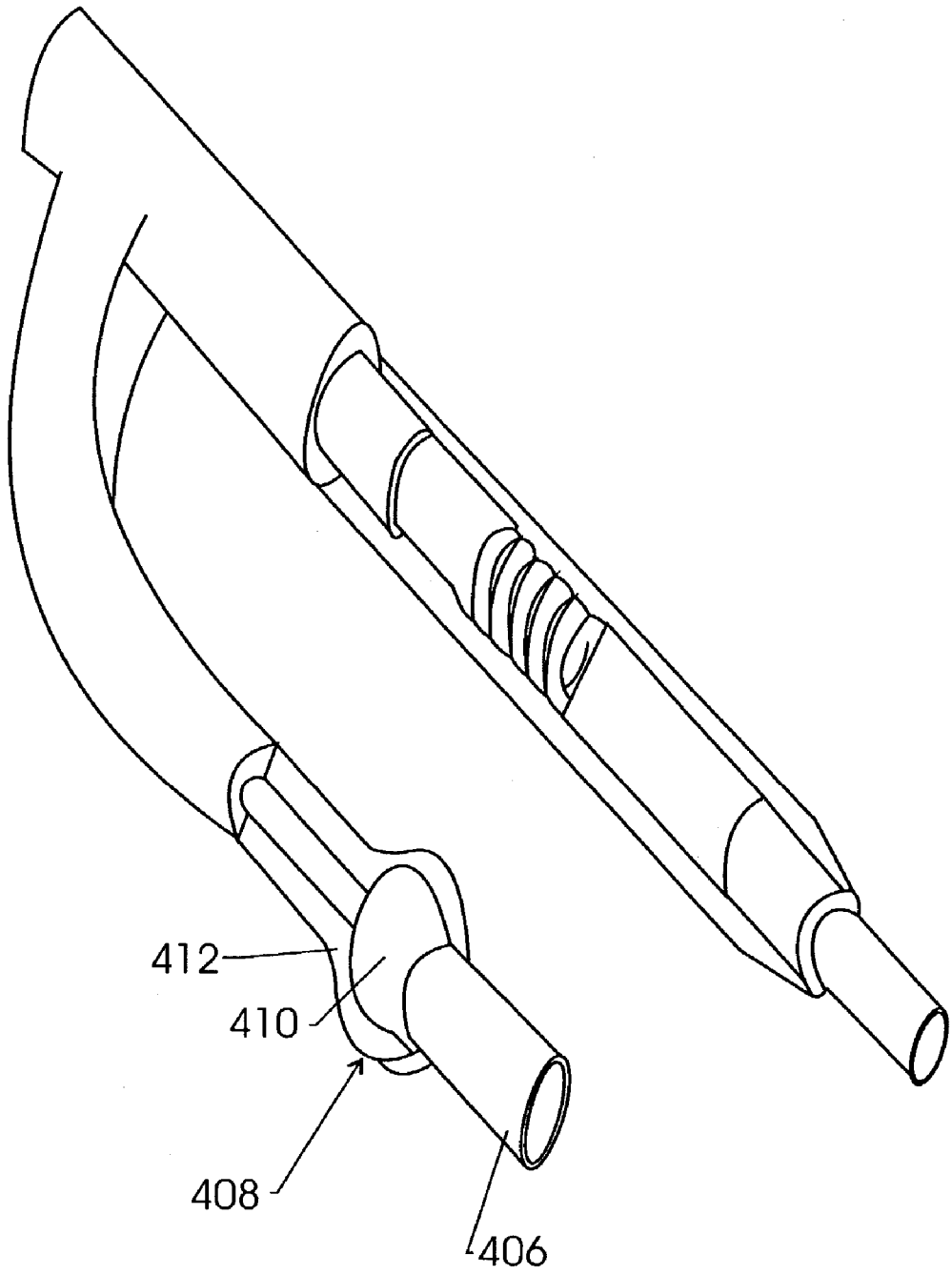
FIG. 33 is an isometric view of a dip tube pivot joint.

Many intelligent completion systems may benefit from a moveable dip tube. For example, when running into deviated wells, a pivotable dip tube design may be utilized, as illustrated in FIG. 33. In this example, a dip tube 406 which may embody many of the dip tubes described above, is coupled to a subject system by a pivot joint 408. By way of example, pivot joint 408 may be constructed by forming a ball 410 at the base of dip tube 406. The ball 410 is sized for receipt in a corresponding receptacle 412 for pivotable movement. The pivot joint 408 enables movement of dip tube 406 as it is run into a given wellbore. The ability to pivot can facilitate movement past obstructions or into deviated wellbores. In deviated wells, the control line also can be strapped externally to a perforated pipe, or friction reducing members, e.g., rollers, can be coupled to the dip tube.

Figure 34:
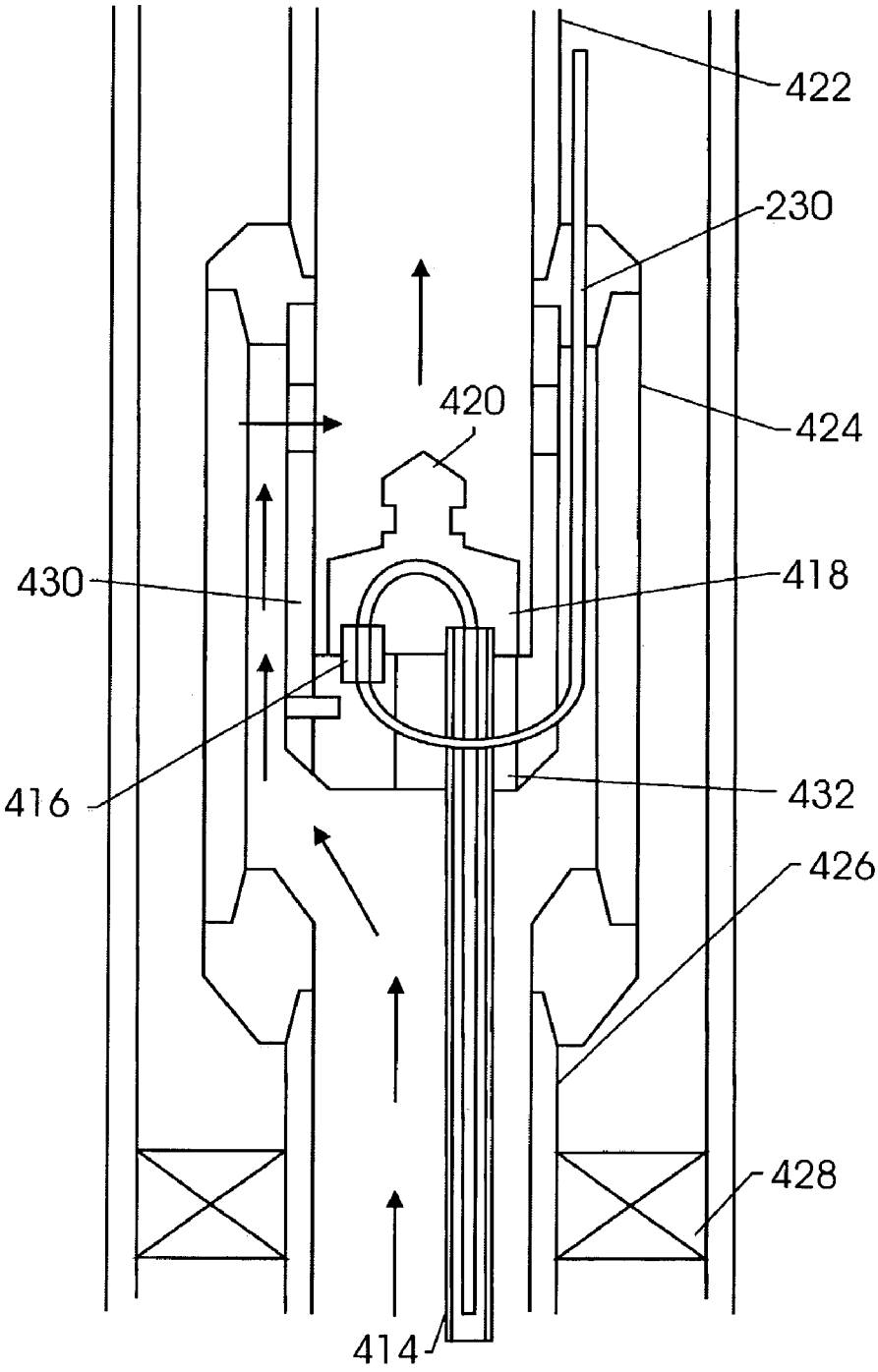
FIG. 34 illustrates an embodiment of a dip tube mounted on a fishable plug.
Figure 35:
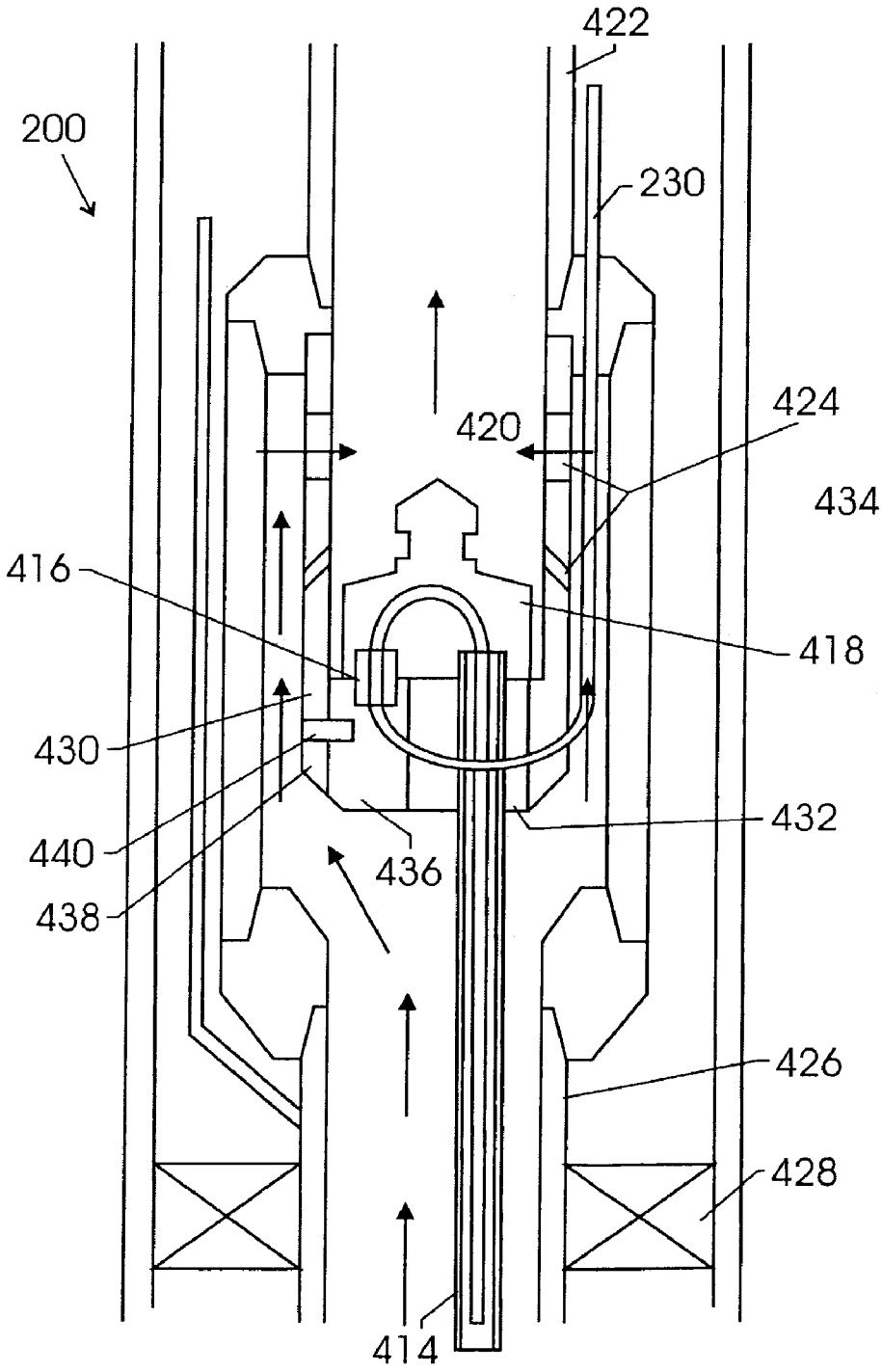
FIG. 35 is a view similar to FIG. 34 with a mechanism to accommodate full bore flow.
Figure 36:
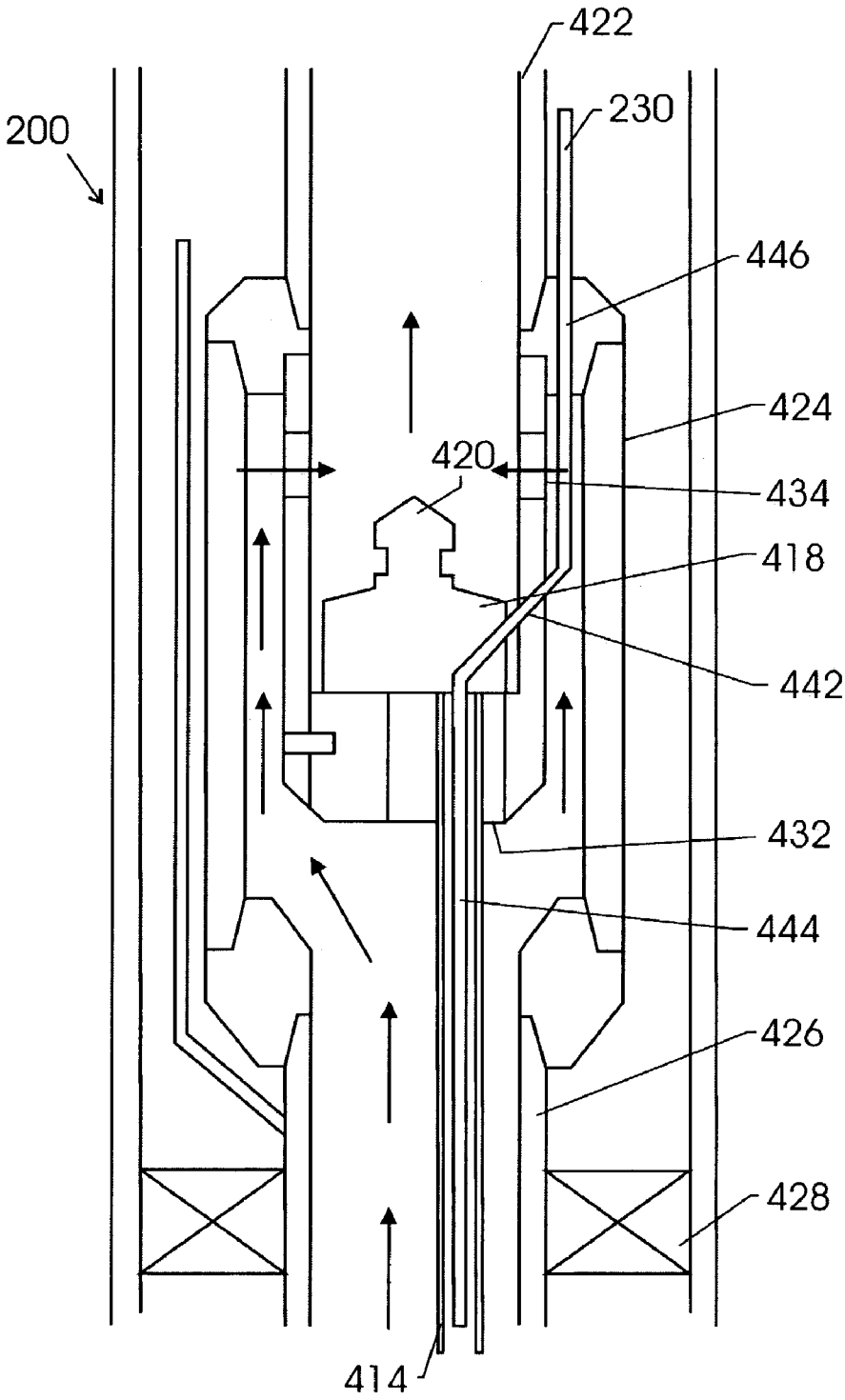
FIG. 36 is a view similar to FIG. 34 illustrating an embodiment of a hydraulic wet connect.

Referring generally to FIGS. 34 through 36, alternate dip tube embodiments are illustrated. In each of these embodiments, a dip tube 414 is deployed at a desired wellbore location. As illustrated in FIG. 34, dip tube 414 and a connector 416 are mounted to a retrievable plug 418 having a fishing feature 420. Fishing feature 420 may be an internal or external feature configured for engagement with a fishing tool (not shown) to permit retrieval and potentially insertion of dip tube 414 through production tubing 422.

Although fishing feature 420 and dip tube 414 may be utilized in a variety of applications, an exemplary application utilizes a flow shroud 424 connected between tubing 422 and a lower segment tubing or sand screen 426. A completion packer 428 is disposed about tubing 426, and dip tube 414 extends into tubing 426 through completion packer 428. In this embodiment, fluid flow typically moves upwardly through tubing 426 into the annulus between flow shroud 424 and in internal mounting mechanism 430 to which retrievable plug 418 is mounted. Mounting mechanism 430 comprises an opening 432 through which dip tube 414 passes and a plurality of flow ports 434 that communicate between the surrounding annulus and the interior of tubing 422. Thus, retrievable plug 418 and dip tube 414 can readily be retrieved through tubing 422 without obstructing fluid flow from tubing 426 to tubing 422.

Furthermore, connector 416 may comprise a variety of connectors, depending on the particular application. For example, the connector may comprise a hydraulic connector for the connection of tubing, or the connector may comprise a fiber optic wet connect or other control line wet connect. These and other types of connectors can be utilized depending on the specific application of the system.

With reference to FIG. 35, a base 436 of mounting mechanism 430 may be formed as a removable component. For example, the base 436 may be coupled to a side wall 438 of mounting mechanism 430 by a sheer pin or other coupling mechanism 440. Thus, the base 436 can be released or broken free from the remainder mounting mechanism 430 to provide a substantially uninhibited axial flow from tubing 426 through mounting mechanism 430 and into tubing 422. By way of example, the fishable dip tube 414 can be retrieved from the completion, and base 436 may be knocked down hole to provide a full bore flow.

A variety of connection features may be incorporated into the overall design depending on the particular application. For example, a hydraulic wet connection feature 442 may be pivotably mounted within retrievable plug 418. In this particular embodiment, the hydraulic wet connection feature 442 is connected to a lower section 444 of control line 230, and the connection feature 442 is pivotably mounted within retrievable plug 418 for pivotable outward motion upon reaching a desired location. For example, when retrievable plug 418 is fully inserted into mounting mechanism 430, as illustrated in FIG. 36, the hydraulic wet connection feature 442 pivots outwardly for engagement with an upper section 446 of control line 230. As described above, the control line 230 may comprise a variety of control lines including tubes, wire, fiber optics and other control lines through which various materials or signals flow. It should also be noted that a variety of other types of connectors can be utilized with the various control line systems illustrated.

Figure 37:
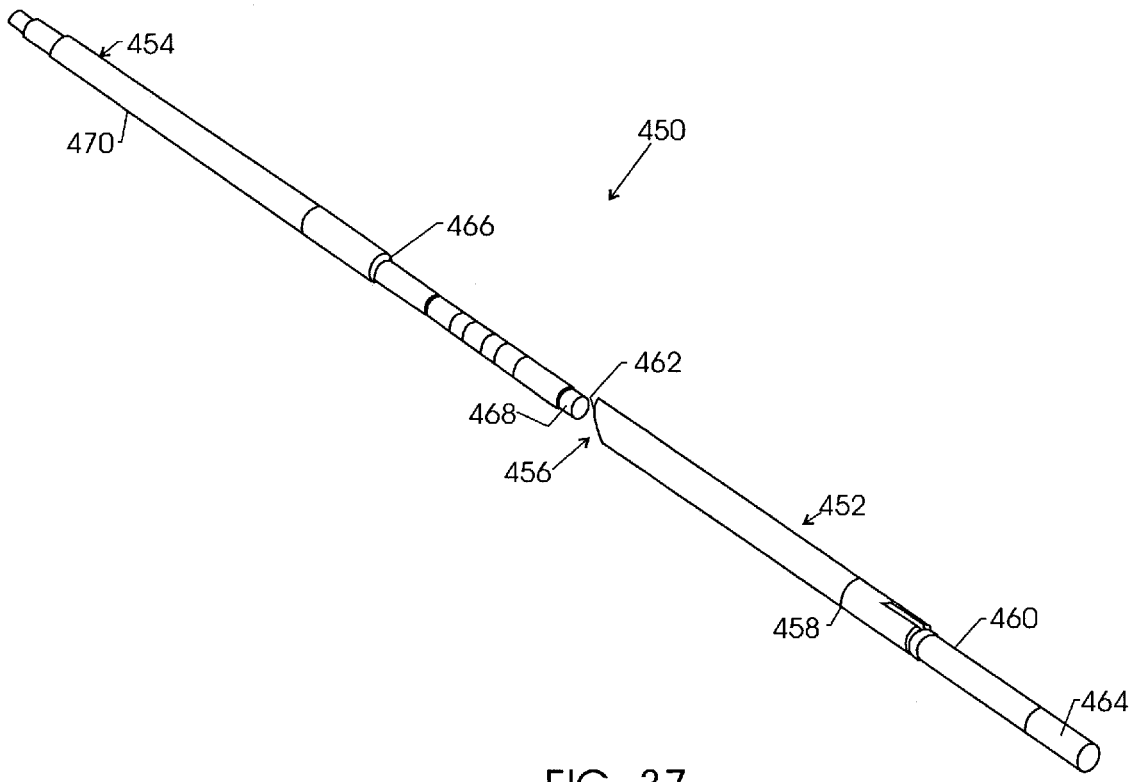
FIG. 37 is a perspective view of an embodiment of a fiber optic engagement system.
Figure 38:
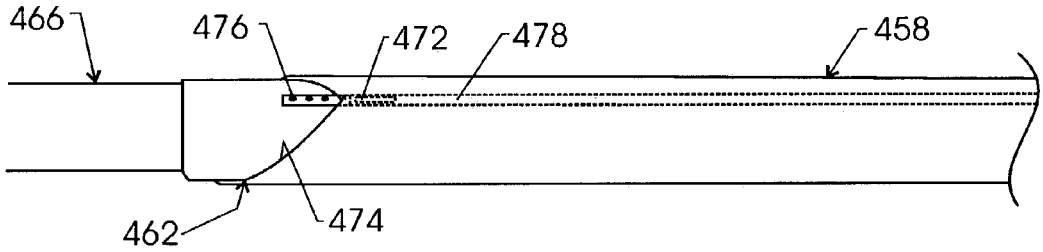
FIG. 38 is an expanded view of an embodiment of a course alignment system illustrated in FIG. 37.
Figure 39:
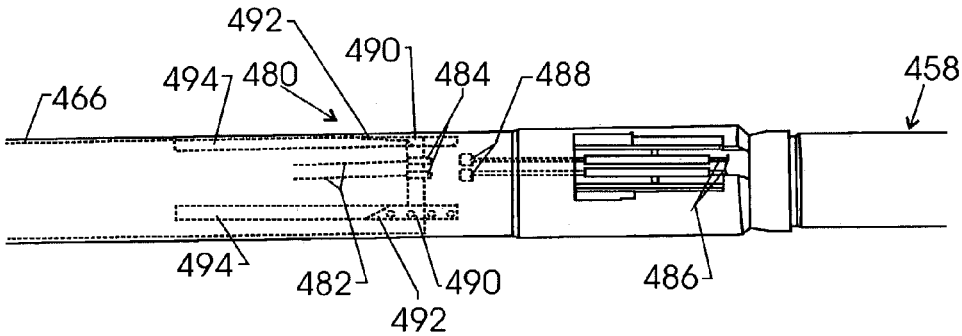
FIG. 39 illustrates an embodiment of fiber optic connectors for use with a system, such as the system illustrated in FIG. 37.

Referring generally to FIGS. 37 through 39, a system 450 for connecting a fiber optic line in a wellbore is illustrated. By way of example, system 450 may comprise a lower completion 452, an upper completion 454 and an alignment system 456. In the embodiment illustrated, lower completion 452 comprises a receptacle assembly 458 having a polished bore receptacle 460, an open receiving end 462 and a receptacle latch 464 generally opposite open receiving end 462.

In this embodiment, upper completion 454 comprises a stinger 466 having a stinger collet 468 at a lead end. A fiber optic cable accumulator 470 is deployed at an end of stinger 466 generally opposite stinger collet 468. In this design, stinger 466 is rotatably coupled to fiber optic accumulator 470. In one embodiment, stinger 466 is rotationally locked with respect to fiber optic cable accumulator as the upper completion is moved downhole, but upon entry of stinger 466 into open receiving end 462, a release lever 472 (see FIG. 38) is actuated to rotationally release stinger 466 with respect to fiber optic cable accumulator 470. Thus, alignment system 456 can rotate stinger 466 to properly align the fiber optic cable segments in lower completion 452 and upper completion 454, enabling a downhole wet connect.

By way of specific example, alignment system 456 may comprise a helical cut 474 formed on open receiving end 462. An alignment key 476 is coupled to stinger 466, and is guided along helical cut 474 and into an internal groove 478 formed along the interior of receptacle assembly 458. Internal groove 478 guides alignment key 476 and stinger 466 as the upper completion 454 and lower completion 452 are moved towards full engagement.

As the insertion of stinger 466 continues towards completion, a fine alignment system 480 moves fiber optic connectors into engagement, as best illustrated in FIG. 39. As illustrated, at least one and often a plurality of fiber optic cable segments 482 extend longitudinally along or through upper completion 454 and terminate at wet plugable connector ends 484. Similarly, fiber optic cable segments 486 extend along or through lower completion 452 to corresponding fiber optic connector ends 488. In this embodiment, a plurality of fine tuning keys 490 are connected to the interior of receptacle assembly 458, as shown schematically in FIG. 39. The fine tuning keys 490 have tapered lead ends 492 that are slidably received in corresponding grooves 494 formed in the exterior of stinger 466. As tapered ends 492 move into grooves 494, the fine tuning keys 490 are able to rotationally adjust stinger 466 for precise plugable connection of connector ends 484 with corresponding connector ends 488 to establish a wet connect between one or more fiber optic cables. It should be noted that the upper and lower completions can utilize a variety of other components, and the arrangement of alignment keys, helical cuts, internal grooves and other features can be interchanged between the upper completion and the lower completion.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for use in a wellbore, comprising:

an upper completion having a tubing;

a lower completion;

a dip tube extending from the upper completion into the lower completion; and a control line extending along the upper completion and into the dip tube.

2. The system as recited in claim 1, wherein the lower completion comprises a sand screen.

3. The system as recited in claim 1, wherein the lower completion comprises an expandable sand screen.

4. The system as recited in claim 1, wherein the dip tube is removable through the tubing.

5. The system as recited in claim 1, wherein the control line comprises a lower section deployed in the dip tube and a wet connect by which the lower section is communicatively coupled to an upper section of the control line upon insertion of the dip tube into the lower completion.

6. The system as recited in claim 5, wherein the control line comprises a plurality of control lines and a plurality of wet connects.

7. The system as recited in claim 4, wherein the dip tube is coupled to the upper completion in a side pocket sub.

8. The system as recited in claim 1, wherein the dip tube comprises a plurality of dip tubes, each dip tube extending into a separate wellbore zone.

9. The system as recited in claim 1, wherein the dip tube is connected to the upper completion while the upper completion is run into the wellbore.

10. The system as recited in claim 1, wherein the dip tube is mounted on a removable plug.

11. The system as recited in claim 1, wherein the dip tube is coupled to the upper completion by a pivot.

12. The system as recited in claim 1, wherein the dip tube and a control line connector are mounted to a fishable plug.

13. A well device comprising:

a dip tube sized for insertion into the interior of a downhole completion, the dip tube having a control line section and a connection feature to enable connection of the control line section to a control line when the dip tube is inserted into the downhole completion.

14. The well device as recited in claim 13, wherein the control line section comprises a fiber optic line.

15. The well device as recited in claim 13, wherein the control line section comprises a distributed temperature sensor.

16. The well device as recited in claim 13, wherein the control line section comprises an electric line.

17. The well device as recited in claim 13, wherein the control line section comprises a fluid line.

18. A well system for deployment in a wellbore, comprising:

a single trip completion having:

a deployment tubing;

a sand screen mounted to the deployment tubing; and a lower packer and an upper packer mounted to the deployment tubing; and a control line extending through the upper packer and the lower packer into cooperation with the sand screen to enable running of the single trip completion and the control line into the wellbore in a single trip.

19. The well system as recited in claim 18, wherein the control line is external to the sand screen.

20. The well system as recited in claim 18, wherein the control line is internal to the sand screen.

21. The well system as recited in claim 18, wherein the control line is deployed in a wall of the sand screen.

22. The well system as recited in claim 18, wherein the single trip completion further comprises a valve system positioned between the upper packer and the lower packer.

23. The well system as recited in claim 18, wherein the sand screen is an expandable sand screen.

24. A system for forming a wet connect in a wellbore, comprising:

a completion having a packer;

a wet connect component disposed below the packer; and a wet connect tool mounted on a production string able to move the wet connect tool through the packer for engagement with the wet connect component.

25. The system as recited in claim 24, wherein the wet connect tool comprises a spring loaded dog.

26. The system as recited in claim 24, wherein the wet connect component and the wet connect tool each comprises a fiber optic line.

27. The system as recited in claim 24, wherein the wet connect component and the wet connect tool each comprises an electrical line.

28. The system as recited in claim 24, wherein the wet connect component and the wet connect tool each comprises a fluid flow line.

29. A method of positioning a completion in a wellbore in a single trip downhole, comprising:

mounting an upper completion and a lower completion to a tubing;

preparing the lower completion with an expandable sand screen;

deploying a control line along the upper completion and the lower completion; and running the upper completion, the lower completion and the control line into the wellbore simultaneously.

30. The method as recited in claim 29, further comprising setting a packer in the lower completion.

31. The method as recited in claim 30, further comprising expanding the sand screen in the lower completion.

32. The method as recited in claim 31, further comprising displacing tubing fluid.

33. The method as recited in claim 32, further comprising setting a packer in the upper completion.

34. The method as recited in claim 29, wherein deploying comprises mounting a fiber optic line at least partially through the upper completion and the lower completion.

35. The method as recited in claim 29, where in deploying comprises mounting a fluid line at least partially through the upper completion and the lower completion.

36. The method as recited in claim 29, wherein deploying comprises mounting an electrical line at least partially through the upper completion and the lower completion.

37. A method of deploying a completion in a wellbore, comprising;

running a completion having a control line into the wellbore in a single trip;

setting a lower packer of the completion;

displacing wellbore fluid in the completion with a completion fluid; and setting an upper packer of the completion.

38. The method as recited in claim 37, further comprising expanding a sand screen of the completion.

39. The method as recited in claim 37, further comprising performing a gravel pack.

40. The method as recited in claim 37, further comprising operating a valve to enable selective pressurization of the completion to set at least one of the lower packer and the upper packer.

41. The method as recited in claim 37, further comprising operating a circulating valve to enable the displacement of wellbore fluid with completion fluid.

42. The method as recited in claim 37, wherein running comprises running the completion with a fiber optic control line.

43. The method as recited in claim 37, wherein displacing comprises displacing the wellbore fluid with a thermal insulation fluid.

44. A method of providing a control line at a wellbore location, comprising:

combining a control line with a dip tube;

inserting the dip tube into the interior of a sand screen; and connecting the dip tube to an upper completion at a position such that the dip tube extends into a lower completion within a wellbore.

45. The method as recited in claim 44, wherein connecting comprises removably connecting the dip tube to the upper completion.

46. The method as recited in claim 44, wherein connecting comprises pivotably connecting the dip tube to the upper completion.

47. The method as recited in claim 44, wherein connecting comprises forming a control line wet connect.

48. The method as recited in claim 44, wherein connecting comprises connecting the dip tube in a side pocket sub.

49. A method of providing a control line at a wellbore location, comprising:

combining a control line with a dip tube;

inserting the dip tube into the interior of a sand screen;

initially running a lower completion into a wellbore;

running an upper completion into the wellbore; and subsequently running the dip tube into the wellbore.

50. A method of providing a control line at a wellbore location, comprising:

combining a control line with a dip tube;

inserting the dip tube into the interior of a sand screen;

wherein inserting comprises running the dip tube into a wellbore.

51. The method as recited in claim 50, wherein combining comprises deploying the control line in the dip tube prior to running the dip tube into the wellbore.

52. The method as recited in claim 50, wherein combining comprises deploying the control line in the dip tube subsequent to running the dip tube into the wellbore.

53. A method, comprising:

establishing a plurality of wellbore zones along a wellbore;

deploying a plurality of dip tubes within the wellbore, such that at least one dip tube extends into each of the plurality of wellbore zones; and utilizing the plurality of dip tubes for providing control lines to the plurality of wellbore zones.

54. The method as recited in claim 53, further comprising providing at least one of the control lines with a wet connect.

55. The method as recited in claim 53, further comprising mounting the plurality of dip tubes to a completion.

56. The method as recited in claim 55, wherein mounting comprises removably mounting at least one of the plurality of dip tubes.

57. The method as recited in claim 53, further comprising deploying a fiber optic line in at least one of the plurality of dip tubes.

58. The method as recited in claim 53, further comprising deploying a distributed temperature sensor in at least one of the plurality of dip tubes.

59. The method as recited in claim 53, further comprising deploying an electric line in at least one of the plurality of dip tubes.

60. The method as recited in claim 53, further comprising deploying a fluid line in at least one of the plurality of dip tubes.

61. A system for connecting a fiber optic line in a wellbore, comprising:

a lower completion having a first fiber optic control line segment with a first connector;

an upper completion having a second fiber optic control line segment with a second connector; and an alignment mechanism to rotate a least a portion of at least one of the lower completion and the upper completion to precisely align the first connector and the second connector for engagement.

62. The system as recited in claim 61, wherein the lower completion comprises a polished bore receptable, and the upper completion comprises a stinger.

63. The system as recited in claim 62, wherein the stinger is rotatable.

64. The system as recited in claim 61, wherein the alignment mechanism comprises a course alignment mechanism and a fine alignment mechanism.

65. The system as recited in claim 64, wherein the fine alignment mechanism comprises a plurality of tuning keys slidably received in corresponding slots.

* * * * *